US012145637B2

(12) United States Patent
Gorman et al.

(10) Patent No.: US 12,145,637 B2
(45) Date of Patent: Nov. 19, 2024

(54) DEVICE, SYSTEM, AND METHOD FOR MONITORING A DISTANCE BETWEEN RAIL CARS DURING COUPLING

(71) Applicant: Transportation IP Holdings, LLC, Norwalk, CT (US)

(72) Inventors: Joseph W. Gorman, Springville, IA (US); Christopher John Claussen, Cedar Rapids, IA (US); Jeffrey D. Kernwein, Cedar Rapids, IA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 394 days.

(21) Appl. No.: 17/544,316

(22) Filed: Dec. 7, 2021

(65) Prior Publication Data

US 2022/0089202 A1 Mar. 24, 2022

Related U.S. Application Data

(63) Continuation-in-part of application No. 16/222,260, filed on Dec. 17, 2018, now abandoned.

(51) Int. Cl.

| | |
|---|---|
| ***B61L 15/00*** | (2006.01) |
| ***B61G 3/00*** | (2006.01) |
| ***B61G 7/00*** | (2006.01) |

(52) U.S. Cl.

CPC ..... *B61L 15/0058* (2024.01); *B61G 3/00* (2013.01); *B61G 7/00* (2013.01); *B61L 15/0081* (2013.01)

(58) Field of Classification Search

CPC ..... B61L 15/0058; B61L 15/0081; B61L 23/041; B61L 15/0072; B61L 25/026; B61G 3/00; B61G 7/00

(Continued)

(56) References Cited

U.S. PATENT DOCUMENTS

2012/0286974 A1 11/2012 Claussen et al.
2016/0311450 A1* 10/2016 Roberts ..... B61L 25/025

(Continued)

FOREIGN PATENT DOCUMENTS

| | | | |
|---|---|---|---|
| DE | 102019109417 A1 | | 10/2020 |
| EP | 3336674 | * | 12/2016 |
| JP | H05197410 | * | 8/1993 |

OTHER PUBLICATIONS

Office Action for corresponding MX Application No. MX/a/2019/011306 dated Apr. 26, 2023 (4 pages).

(Continued)

*Primary Examiner* — Muhammad Shafi
(74) *Attorney, Agent, or Firm* — K&L Gates LLP

(57) ABSTRACT

A system may include a sensor that detects positioning data indicative of a position of a first coupler of a first vehicle system and positioning data indicative of a position of a second coupler of a second vehicle system during a coupling event of the vehicle systems. A controller includes one or more processors that receive the positioning data of the first and second couplers and determines whether the first coupler is misaligned with the second coupler. The controller may initiate an action of the first coupler, the second coupler, the first vehicle system, or the second vehicle system to change a position of the first coupler, the second coupler, the first vehicle system, or the second vehicle system. Changing the position of the first coupler, the second coupler, the first vehicle system, or the second vehicle system aligns the first coupler with the second coupler.

19 Claims, 6 Drawing Sheets

(58) Field of Classification Search
USPC ..... 701/19
See application file for complete search history.

(56) References Cited

U.S. PATENT DOCUMENTS

2018/0312179 A1* 11/2018 Lucisano ..... B61L 15/0081
2020/0189631 A1 6/2020 Gorman et al.

OTHER PUBLICATIONS

Second Office Action for corresponding MX Application No. MX/a/2019/011306 dated Jun. 21, 2023 (4 pages).
Extended European Search Report for corresponding EP Application No. 22207768.7 dated Dec. 4, 2023 (9 pages).

* cited by examiner

DEVICE, SYSTEM, AND METHOD FOR MONITORING A DISTANCE BETWEEN RAIL CARS DURING COUPLING

CROSS-REFERENCE TO RELATED APPLICATIONS

This application is a continuation-in-part of U.S. patent application Ser. No. 16/222,260, filed on 17 Dec. 2018. The entire disclosure of which is incorporated herein by reference.

BACKGROUND

Technical Field

The present disclosure relates to train operation and, more particularly, to monitoring and controlling a distance between train vehicles during coupling procedures

Discussion of Art

Train coupling involves the movement of one or more rail cars (e.g., locomotives, passenger vehicles, cargo vehicles, etc.) along a track to connect two rail cars using couplers. Present coupling methods involve having an individual positioned in view of the coupling task relaying information with a voice radio to inform a train operator of the distance between the train vehicles being coupled. This can be imprecise and unsafe due to factors related to the individual observing the coupling move, such as distractions, radio communication issues, being incorrect about the estimated distance they relay to the train operator, and/or the like. Furthermore, there may be environmental hazards that increase the difficulty of manually monitoring the coupling process, including darkness, fog, snowy or icy conditions, windy conditions, uneven terrain surrounding the track, and/or the like. Additionally, there is an unavoidable lag time associated with one person observing and reporting the coupling status while another person listens and controls the movement, and such manual observation and reporting does not get recorded and is not reviewable if a coupling accident were to occur.

Accordingly, there is a need in the art for a device, system, and method of coupling without the requirement of physical human observation and reporting at the point of train vehicle coupling. Moreover, there is a need for a technical solution to provide more precise and immediate distance and movement feedback during coupling, to reduce lag time, reduce error, promote automation, and create a verifiable and reviewable data log.

BRIEF DESCRIPTION

Generally, provided is a device, system, and method for monitoring a distance between a first rail car and a second rail car during coupling. Preferably, provided is a device, system, and method for receiving distance data from a distance sensor configured to detect the distance between the first rail car and the second rail car. Preferably, provided is a device, system, and method for controlling, based at least partially on the distance data, movement of the first rail car and/or the second rail car to reduce the distance between the cars. Preferably, provided is a device, system, and method for stopping movement of the first rail car and/or the second rail car in response to determining that the distance between the cars satisfies a predetermined threshold that is representative of a completed rail car coupling.

In non-limiting embodiments or aspects, provided is a device for monitoring a distance between a first rail car and a second rail car during coupling. The device includes a fastener configured to affix the device to the first rail car. The device also includes a distance sensor configured to detect the distance between the first rail car and the second rail car in a direction away from an end of the first rail car and toward an end of the second rail car. The device further includes a power source and a data connector to communicatively connect the device to a remote processor. The device further includes a local processor programmed or configured to repeatedly receive distance data from the distance sensor of the distance between the first rail car and the second rail car. The local processor is also programmed or configured to repeatedly communicate the distance data to the remote processor and cause the initiation of at least one train action at least partially based on the distance data.

In further non-limiting embodiments or aspects, the device may be separate from and communicatively connected to an end-of-train (EQT) device. The distance sensor may include at least one of the following: a LIDAR sensor, a radar sensor, a sonar sensor, an optical sensor (e.g., a camera or the like), an ultrasonic sensor, a thermal sensor, or a combination thereof. The fastener may include at least one magnet configured to removably and temporarily affix the device to the first rail car.

In further non-limiting embodiments or aspects, the data connector may be communicatively connected to a data trainline of a train equipped with an electronically controlled pneumatic braking system. The power source may include a wired power connection to a power trainline of the train.

In further non-limiting embodiments or aspects, the data connector may include a wireless transceiver for wireless communication to a mobile device located with a train operator and/or to an onboard computing device located on a locomotive associated with the first rail car or the second rail car. The power source may include a rechargeable battery pack. A data connection of the data connector to the mobile device and/or the onboard computing device may be persistent or non-persistent.

In further non-limiting embodiments or aspects, the local processor may be further programmed or configured to increase a rate of receiving the distance data of the distance between the first rail car and the second rail car, and communicating the distance data to the remote processor as the distance between the first rail car and the second rail car decreases.

In further non-limiting embodiments or aspects, the device and a locomotive associated with the first rail car or the second rail car may be configured to be remotely controlled by the remote processor such that the distance data communicated from the device to the remote processor is at least partially used by the remote processor to automatically operate the locomotive to complete a coupling of the first rail car and the second rail car.

In further non-limiting embodiments or aspects, the local processor may be further programmed or configured to angle the distance sensor and/or filter, at the device, the distance data to account for non-linear rail under the first rail car or the second rail car during coupling of the first rail car and the second rail car.

In further non-limiting embodiments or aspects, the device may be configured to additionally report the distance between the first rail car and the second rail car using, and further including, at least one of the following: a speaker, an indicator light, a display, or any combination thereof In non-limiting embodiments or aspects, provided is a system for monitoring a distance between a first rail car and a second rail car during coupling. The system includes a computing device positioned remotely from the first rail car and the second rail car. The computing device is programmed or configured to receive distance data of the distance between the first rail car and the second rail car. The computing device is also programmed or configured to display the distance data on a display device. The system also includes a distance monitoring device. The distance monitoring device includes a fastener configured to affix the device to the first rail car. The distance monitoring device also includes a distance sensor configured to detect the distance between the first rail car and the second rail car in a direction away from an end of the first rail car and toward an end of the second rail car. The distance monitoring device further includes a power source and a data connector to communicatively connect the distance monitoring device to the computing device. The distance monitoring device further includes a local processor programmed or configured to repeatedly receive the distance data from the distance sensor of the distance between the first rail car and the second rail car, and communicate the distance data to the computing device for display.

In further non-limiting embodiments or aspects, the distance sensor may include at least one of the following: a LIDAR sensor, a radar sensor, a sonar sensor, an optical sensor, an ultrasonic sensor, a thermal sensor, or a combination of one or more thereof. The system may include an end-of-train (EQT) device including the distance monitoring device.

In further non-limiting embodiments or aspects, the data connector may be communicatively connected to a data trainline of an ECP-equipped train. The power source may include a wired power connection to a power trainline of the ECP-equipped train.

In further non-limiting embodiments or aspects, the data connector may include a wireless transceiver for wireless communication to the computing device. The computing device may be located with a train operator and/or on a locomotive associated with the first rail car or the second rail car. The power source may include a rechargeable battery pack.

In further non-limiting embodiments or aspects, the local processor may be further programmed or configured to increase a rate of receiving the distance data of the distance between the first rail car and the second rail car, and communicating the distance data to the computing device as the distance between the first rail car and the second rail car decreases.

In further non-limiting embodiments or aspects, the distance monitoring device and a locomotive associated with the first rail car or the second rail car may be configured to be remotely controlled by the computing device such that the distance data communicated from the distance monitoring device to the computing device is at least partially used by the computing device to automatically operate the locomotive to complete a coupling of the first rail car and the second rail car.

In further non-limiting embodiments or aspects, the local processor may be further programmed or configured to angle the distance sensor and/or filter, at the distance monitoring device, the distance data to account for non-linear rail under the first rail car or the second rail car during coupling of the first rail car and the second rail car.

In non-limiting embodiments or aspects, provided is a computer-implemented method for monitoring a distance between a first rail car and a second rail car during coupling. The method includes receiving, with at least one processor, distance data from a distance sensor of a distance monitoring device. The distance monitoring device is affixed to the first rail car and is positioned between the first rail car and the second rail car. The distance sensor is configured to detect the distance between the first rail car and the second rail car in a direction away from an end of the first rail car and toward an end of the second rail car. The method also includes controlling, with at least one processor and based at least partially on the distance data, movement of the first rail car and/or the second rail car to reduce the distance between the first rail car and the second rail car. The method further includes stopping, with at least one processor and based at least partially on the distance data, movement of the first rail car and/or the second rail car in response to determining that the distance between the first rail car and the second rail car satisfies a predetermined threshold distance between the first rail car and the second rail car that is representative of a completed rail car coupling.

In further non-limiting embodiments or aspects, the method may include detecting, with at least one processor and based at least partially on the distance data, at least one obstacle between the first rail car and the second rail car. The method may further include temporarily suspending, with at least one processor, movement of the first rail car and/or the second rail car until the at least one obstacle is no longer detected between the first rail car and the second rail car.

Further non-limiting embodiments are set forth in the following numbered clauses.

Clause 1: A device for monitoring a distance between a first rail car and a second rail car during coupling, comprising: a fastener configured to affix the device to the first rail car; a distance sensor configured to detect the distance between the first rail car and the second rail car in a direction away from an end of the first rail car and toward an end of the second rail car; a power source; a data connector to communicatively connect the device to a remote processor; and a local processor programmed or configured to repeatedly: receive distance data from the distance sensor of the distance between the first rail car and the second rail car; and communicate the distance data to the remote processor; and cause the initiation of at least one train action at least partially based on the distance data.

Clause 2: The device of clause 1, wherein the device is separate from and communicatively connected to an end-of-train (EQT) device, and wherein the distance sensor comprises at least one of the following: a LIDAR sensor, a radar sensor, a sonar sensor, or a combination thereof.

Clause 3: The device of clause 1 or 2, wherein the fastener comprises at least one magnet configured to removably and temporarily affix the device to the first rail car.

Clause 4: The device of any of clauses 1-3, wherein the data connector is communicatively connected to a data trainline of a train equipped with an electronically controlled pneumatic braking system, and wherein the power source comprises a wired power connection to a power trainline of the train.

Clause 5: The device of any of clauses 1-4, wherein the data connector comprises a wireless transceiver for wireless communication to a mobile device located with a train operator and/or to an onboard computing device located on a locomotive associated with the first rail car or the second rail car, and wherein the power source comprises a rechargeable battery pack.

Clause 6: The device of any of clauses 1-5, wherein a data connection of the data connector to the mobile device and/or the onboard computing device is persistent.

Clause 7: The device of any of clauses 1-6, wherein the local processor is further programmed or configured to increase a rate of receiving the distance data of the distance between the first rail car and the second rail car and communicating the distance data to the remote processor as the distance between the first rail car and the second rail car decreases.

Clause 8: The device of any of clauses 1-7, wherein the device and a locomotive associated with the first rail car or the second rail car are configured to be remotely controlled by the remote processor such that the distance data communicated from the device to the remote processor is at least partially used by the remote processor to automatically operate the locomotive to complete a coupling of the first rail car and the second rail car.

Clause 9: The device of any of clauses 1-8, wherein the local processor is further programmed or configured to angle the distance sensor and/or filter, at the device, the distance data to account for non-linear rail under the first rail car or the second rail car during coupling of the first rail car and the second rail car.

Clause 10: The device of any of clauses 1-9, the device being configured to additionally report the distance between the first rail car and the second rail car using and further comprising at least one of the following: a speaker, an indicator light, a display, or any combination thereof.

Clause 11: A system for monitoring a distance between a first rail car and a second railcar during coupling, the system comprising: a computing device positioned remotely from the first rail car and the second rail car, the computing device being programmed or configured to: receive distance data of the distance between the first rail car and the second rail car; and display the distance data on a display device; and a distance monitoring device comprising: a fastener configured to affix the device to the first rail car; a distance sensor configured to detect the distance between the first rail car and the second rail car in a direction away from an end of the first rail car and toward an end of the second rail car; a power source; a data connector to communicatively connect the distance monitoring device to the computing device; and a local processor programmed or configured to repeatedly: receive the distance data from the distance sensor of the distance between the first rail car and the second rail car; and communicate the distance data to the computing device for display.

Clause 12: The system of clause 11, wherein the distance sensor comprises at least one of the following: a LIDAR sensor, a radar sensor, a sonar sensor, or a combination thereof Clause 13: The system of clause 11 or 12, further comprising an end-of-train (EQT)device comprising the distance monitoring device.

Clause 14: The system of any of clauses 11-13, wherein the data connector is communicatively connected to a data trainline of an ECP-equipped train, and wherein the power source comprises a wired power connection to a power trainline of the ECP-equipped train.

Clause 15: The system of any of clauses 11-14, wherein the data connector comprises a wireless transceiver for wireless communication to the computing device, the computing device being located with a train operator and/or on a locomotive associated with the first rail car or the second rail car, and wherein the power source comprises a rechargeable battery pack.

Clause 16: The system of any of clauses 11-15, wherein the local processor is further programmed or configured to increase a rate of receiving the distance data of the distance between the first rail car and the second rail car, and communicating the distance data to the computing device as the distance between the first rail car and the second rail car decreases.

Clause 17: The system of any of clauses 11-16, wherein the distance monitoring device and a locomotive associated with the first rail car or the second rail car are configured to be remotely controlled by the computing device such that the distance data communicated from the distance monitoring device to the computing device is at least partially used by the computing device to automatically operate the locomotive to complete a coupling of the first rail car and the second rail car.

Clause 18: The system of any of clauses 11-17, wherein the local processor is further programmed or configured to angle the distance sensor and/or filter, at the distance monitoring device, the distance data to account for non-linear rail under the first rail car or the second rail car during coupling of the first rail car and the second rail car.

Clause 19: A computer-implemented method for monitoring a distance between a first rail car and a second rail car during coupling, the method comprising: receiving, with at least one processor, distance data from a distance sensor of a distance monitoring device, the distance monitoring device affixed to the first rail car and positioned between the first rail car and the second rail car, the distance sensor configured to detect the distance between the first rail car and the second rail car in a direction away from an end of the first rail car and toward an end of the second rail car; controlling, with at least one processor and based at least partially on the distance data, movement of the first rail car and/or the second rail car to reduce the distance between the first rail car and the second rail car; and stopping, with at least one processor and based at least partially on the distance data, movement of the first rail car and/or the second rail car in response to determining that the distance between the first rail car and the second rail car satisfies a predetermined threshold distance between the first rail car and the second rail car that is representative of a completed rail car coupling.

Clause 20: The method of claim 19, further comprising: detecting, with at least one processor and based at least partially on the distance data, at least one obstacle between the first rail car and the second rail car; and temporarily suspending, with at least one processor, movement of the first rail car and/or the second rail car until the at least one obstacle is no longer detected between the first rail car and the second rail car.

In one or more embodiments described herein, a system may include a sensor that may detect positioning data indicative of a position of a first coupler of a first vehicle system and positioning data indicative of a position of a second coupler of a second vehicle system during a coupling event of the first vehicle system and the second vehicle system. A controller may include one or more processors that may receive the positioning data of the first coupler and the positioning data of the second coupler. The controller may determine whether the first coupler is misaligned with the second coupler based on a comparison of the position of the first coupler and the position of the second coupler. The first coupler may be prohibited from coupling with the second coupler while the first and second couplers are misaligned. The controller may initiate at least one action of one or more of the first coupler, the second coupler, the first vehicle system, or the second vehicle system to change a position of one or more of the first coupler, the second coupler, the first vehicle system, or the second vehicle system. Changing the position of the one or more of the first coupler, the second coupler, the first vehicle system, or the second vehicle system aligns the first coupler with the second coupler.

In one or more embodiments described herein, a method may include detecting positioning data indicative of a position of a first coupler of a first vehicle system and positioning data indicative of a position of a second coupler of a second vehicle system during a coupling event of the first vehicle system and the second vehicle system. A determination may be made whether the first coupler is misaligned with the second coupler based on a comparison of the position of the first coupler and the position of the second coupler. The first coupler may be prohibited from coupling with the second coupler while the first and second couplers are misaligned. At least one action of one or more of the first coupler, the second coupler, the first vehicle system, or the second vehicle system may be initiated responsive to determining that the first coupler is misaligned with the second coupler to change a position of one or more of the first coupler, the second coupler, the first vehicle system, or the second vehicle system. Changing the position of one or more of the first coupler, the second coupler, the first vehicle system, or the second vehicle system aligns the first coupler with the second coupler.

In one or more embodiments described herein, a system may include a monitoring device including one or more sensors that may detect positioning data indicative of a position of a first coupler of a first rail vehicle and positioning data indicative of a position of a second coupler of a second rail vehicle during a coupling event of the first rail vehicle and the second rail vehicle. A controller may include one or more processors that may control operation of one or more of the first coupler, the second coupler, the first rail vehicle, or the second rail vehicle. The controller may receive the positioning data of the first coupler and the positioning data of the second coupler. The controller may determine whether the first coupler is misaligned with the second coupler based on a comparison of the position of the first coupler and the position of the second coupler. The first coupler may be determined to be misaligned with the second coupler based on a difference between the position of the first coupler and the position of the second coupler being outside a determined alignment threshold. The controller may initiate at least one action of one or more of the first coupler, the second coupler, the first rail vehicle, or the second rail vehicle responsive to determining that the first coupler is misaligned with the second coupler to change a position of one or more of the first coupler, the second coupler, the first rail vehicle, or the second rail vehicle. Changing the position of the one or more of the first coupler, the second coupler, the first rail vehicle, or the second rail vehicle aligns the first coupler with the second coupler. The controller may initiate at least one action of one or more of a component of the first coupler or a component of the second coupler responsive to determining that the first coupler is aligned with the second coupler. The controller may receive sensor data from the monitoring device responsive to the initiation of the at least one action of the one or more of the component of the first coupler or the component of the second coupler. The sensor data may be indicative of completion of the at least one action of the one or more of the component of the first coupler or the component of the second coupler and completion of the coupling event.

These and other features and characteristics of the present disclosure, as well as the methods of operation and functions of the related elements of structures and the combination of parts and economies of manufacture, will become more apparent upon consideration of the following description, and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular forms of "a," "an," and "the" include plural referents unless the context clearly dictates otherwise.

BRIEF DESCRIPTION OF THE DRAWINGS

The inventive subject matter may be understood from reading the following description of non-limiting embodiments, with reference to the attached drawings, wherein below.

DETAILED DESCRIPTION

In non-limiting embodiments or aspects of the present disclosure, provided are a device, system, and method for monitoring a distance between a first rail car and a second rail car during coupling. Described non-limiting embodiments or aspects improve over prior art systems by increasing the precision of proximity detection between two coupling train vehicles, as well as providing for closed-loop automation of train coupling processes by using distance data feedback to control locomotion and rail car movement. Described non-limiting embodiments or aspects further improve over prior art systems by providing for traceability and verifiability of historic coupling procedures, by generating logs of such procedures based on distance data, time of day, operator identifiers, train identifiers, track location, and/or the like-thereby providing analyzable metrics of successful couplings and failed couplings, which can further improve the algorithms used in closed-loop automation. Moreover, the removal of personnel at the coupling site improves over prior art systems by eliminating dangers inherent to track bystanders, and it further improves on the reliability of distance reporting, avoiding biases present in physical observation. By communicatively connecting a distance monitoring device with one or more remote processors (e.g., a locomotive computing device, a mobile device associated with a locomotive operator, a back office server, and/or the like), interoperability is improved while allowing for remote controlling and viewing of coupling processes. These advantages, among others, are further illustrated in the detailed description below.

Figure 1:
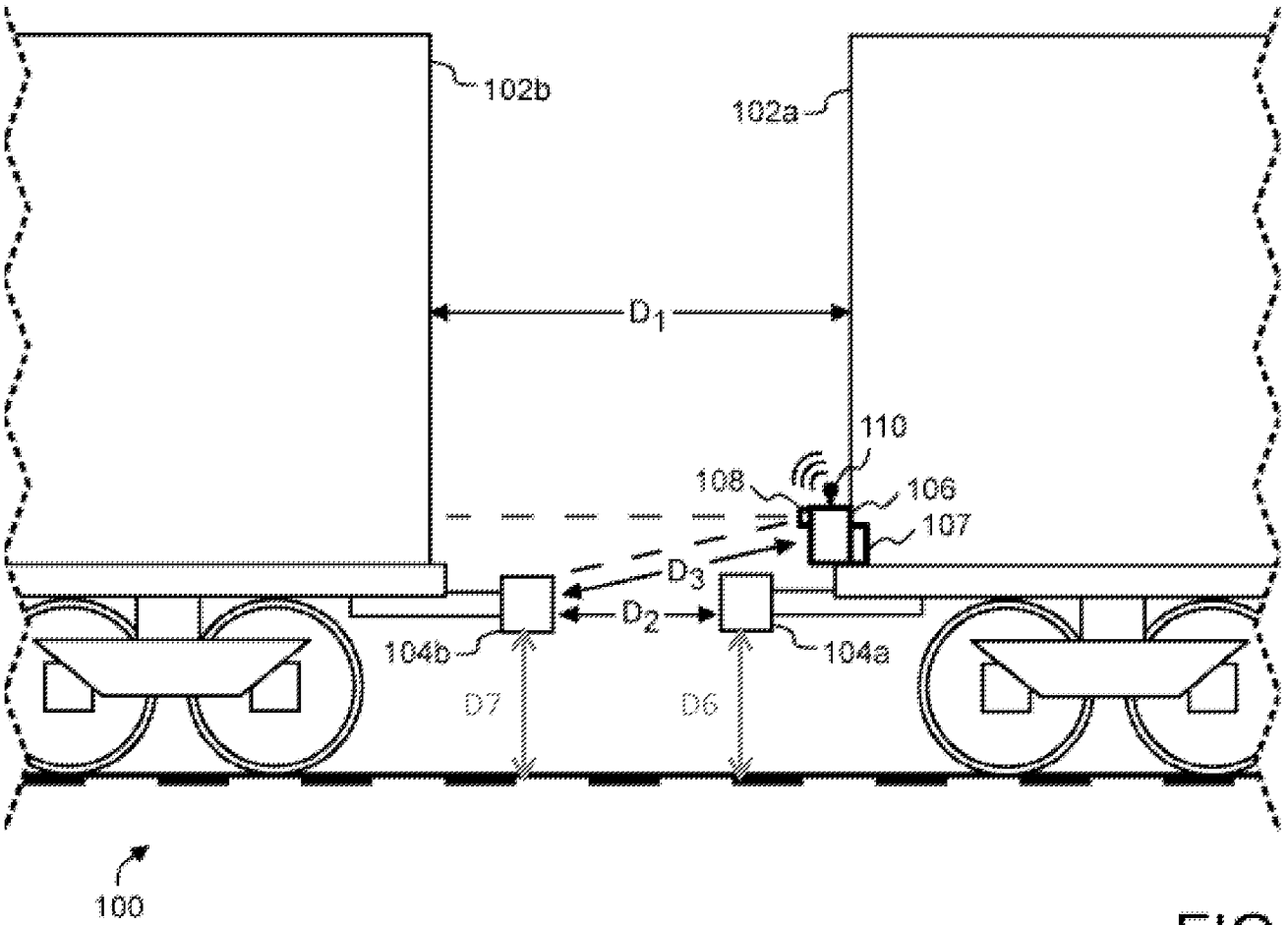
FIG. 1 is a schematic diagram of non-limiting embodiments or aspects of a device, system, and method for monitoring a distance between a first rail car and a second rail car during coupling.
Figure 2:
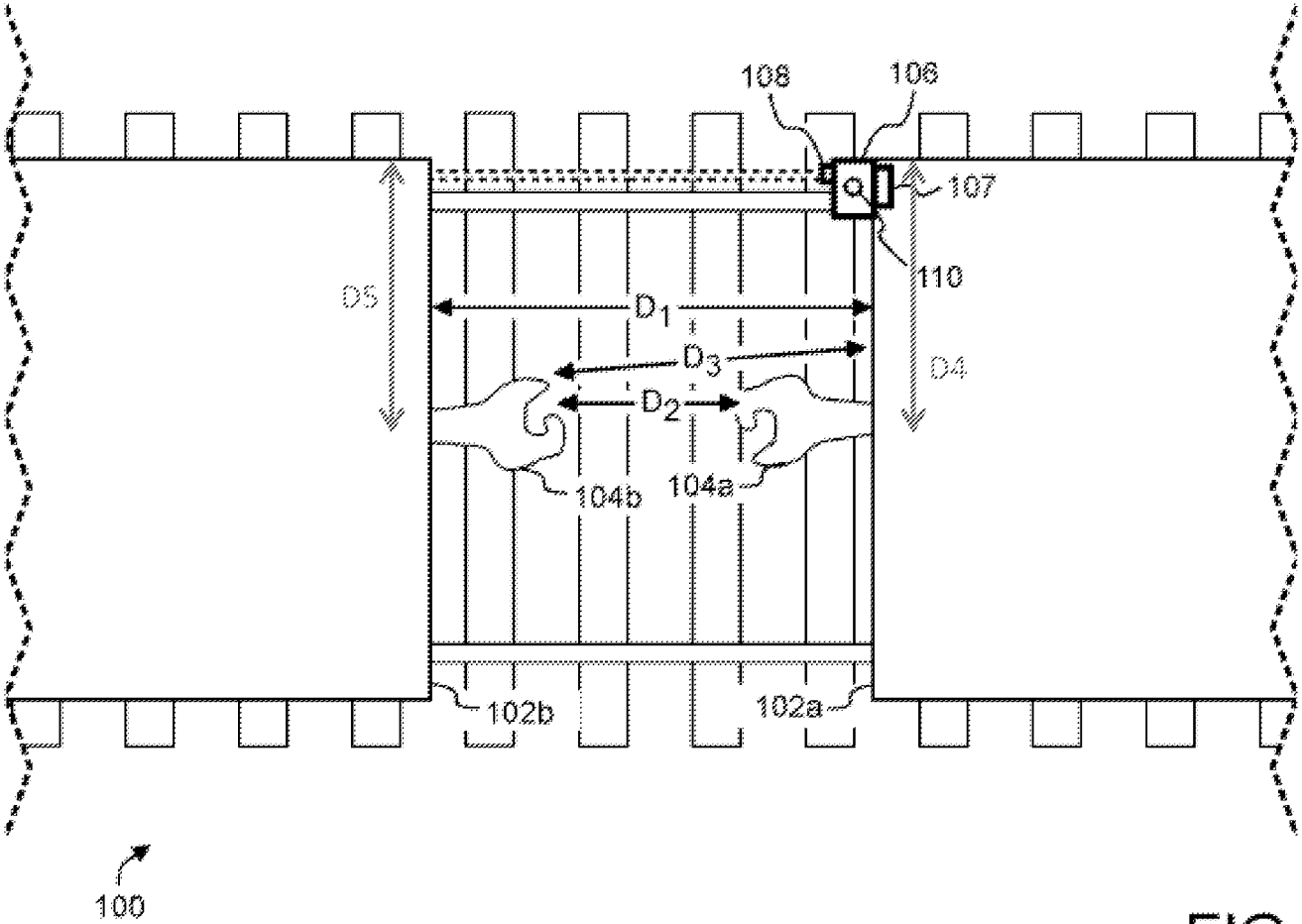
FIG. 2 is a schematic diagram of non-limiting embodiments or aspects of a device, system, and method for monitoring a distance between a first rail car and a second rail car during coupling.

With reference to FIGS. 1 and 2, and in non-limiting embodiments or aspects, provided is a system 100 for monitoring a distance between a first vehicle system and a second vehicle system during coupling of the two or more vehicle systems. As one example, the system may monitor a distance between a first rail car 102*a* and a second rail car 102*b* during coupling. Rail cars 102*a*, 102*b* may include any type of train/railway vehicle for carrying cargo, carrying passengers, carrying train equipment, providing locomotion, or a combination thereof, including, but not limited to: boxcars, coil cars, combine cars, flatcars, Schnabel cars, gondolas, stock cars, tank cars, locomotives, fuel cars, and/or the like. While one or more embodiments are described in connection with rail vehicles, not all embodiments are limited to rail vehicle systems. Unless expressly disclaimed or stated otherwise, the inventive subject matter described herein extends to other types of vehicle systems such as automobiles, trucks (with or without trailers), buses, marine vessels, aircraft, mining vehicles, agricultural vehicles, or other off-highway vehicles. The vehicle systems described herein (rail vehicle systems of other vehicle systems that do not travel on rails or tracks) can be formed from a single vehicle or multiple vehicles. With respect to multi-vehicle systems, the vehicles can be mechanically coupled with each other (e.g., by couplers) or logically coupled but not mechanically coupled. For example, vehicles may be logically but not mechanically coupled when the separate vehicles communicate with each other to coordinate movements of the vehicles with each other so that the vehicles travel together (e.g., as a convoy).

The first rail car 102*a* includes a first coupler 104*a* for connection to other rail cars. The second rail car 102*b* likewise includes a second coupler 104*b* for connection to other rail cars. During a coupling procedure of the first rail car 102*a* to the second rail car 102*b*, the first coupler 104*a* is configured to attach to the second coupler 104*b* (and/or vice versa), thereby connecting the first rail car 102*a* and the second rail car 102*b* in the train consist. Couplers may include any sufficient car-to-car connecting device including, but are not limited to, buffer and chain couplers, link and pin couplers, hook couplers, knuckle couplers, radial couplers, bell-and-hook couplers, electromagnetic couplers, automatic couplers, and/or the like. The rail cars 102*a*, 102*b* may be at least partially self-propelled, and/or the train consist may include a locomotive (not shown) for generating movement of a rail car 102*a*, 102*b*. It will be appreciated that many configurations are possible.

With further reference to FIGS. 1 and 2, and in further non-limiting embodiments or aspects, the system 100 includes a distance monitoring device 106 to provide distance feedback of a coupling process between the first rail car 102*a* and the second rail car 102*b*. The distance monitoring device 106 may include a fastener 107, a distance sensor 108, a power source, a data connector 110, and a local processor. The fastener 107 is configured to affix the distance monitoring device 106 to the first rail car 102*a* or the second rail car 102*b*. One or more distance monitoring devices 106 may be affixed to the first rail car 102*a* and/or the second rail car 102*b*. The depicted non-limiting configuration of FIGS. 1 and 2 illustrates a distance monitoring device 106 affixed to the first rail car 102*a*, but it will be appreciated that this arrangement can be reversed and many configurations are possible. The fastener 107 may include, but is not limited to, a magnet (e.g., a permanent magnet, an electromagnet, etc.), a magnetic material for attraction to a magnet on the rail car 102*a*, 102*b*, a threaded fastener (e.g., nut-and-bolt, screw, stud, etc.), a clamp, a clip, a tie, a strap, a snap, and/or the like. One or more fasteners 107 may be used to secure the distance monitoring device 106 to the first rail car 102*a*, and more than one type of fastener 107 may be used in combination. The fastener 107 may affix the distance monitoring device 106 to a rail car sidewall, a rail car frame (e.g., a flatcar bed), a coupler 104*a*, 104*b* of a rail car 102*a*, 102*b*, or any portion of a rail car 102*a*, 102*b* such that the distance sensor 108 may determine the proximity of the rail cars 102*a*, 102*b* during coupling.

With further reference to FIGS. 1 and 2, and in further non-limiting embodiments or aspects, the distance sensor 108 is configured to detect the proximity of the second rail car 102*b* to the first rail car 102*a*, and it may be configured to measure a distance between the rail cars 102*a*, 102*b*. The distance sensor 108 may also measure the relative speed of one railcar 102*a*, 102*b* to another, by a local processor configured to determine a change in distance between the rail cars 102*a*, 102*b* over time, which may be useful to predict the coupling speed of the railcars 102*a*, 102*b*, to signal an alarm if the coupling is determined to occur beyond predetermined, reasonable speeds. The distance sensor 108 may include, but is not limited to, a Doppler sensor, a magnetic field sensor, an optical sensor (e.g., photoelectric, photocell, laser rangefinder, infrared, a camera),a radar sensor, a LIDAR sensor, a sonar sensor, an ultrasonic sensor, and/or the like. The distance monitoring device 106 may include one or more distance sensors 108, including one or more types of distance sensor 108. The distance monitoring device 106 may use the distance sensor 108 to determine a distance between rail car bodies D1, a distance between a rail car body and a coupler D3, a distance between couplers D2, or a combination thereof. It will be appreciated that many configurations are possible, and the distance monitoring device 106 may be configured to determine a distance between any point associated with the first rail car 102*a* and any point associated with the second rail car 102*b*. The distance data from the distance sensor 108 may be in the form of an analog or digital signal, and the distance data may be representative of a distance value (e.g., ten meters, twenty feet, etc.), a distance category or binary value (e.g., far, near, detected/not detected, connected/not connected, etc.), and/or the like. The distance sensor 108 may also facilitate the detection of speed of the rail cars 102*a*, 102*b* relative to one another, as a processor may evaluate a change in distance over time. It will be appreciated that many configurations are possible.

In one or more embodiments, the distance monitoring device may determine a position of the first coupler 104*a* and a position of the second coupler 104*b*. For example, the distance monitoring device may receive positioning data indicative of a position of the first coupler and positioning data indicative of a position of the second coupler. The positioning data of the first and second couplers may indicate positions of the first and second couplers, respectively, in a three-dimensional space. In one embodiment, the distance monitoring device may receive the positioning data during a coupling event of the first and second couplers. The positioning data of the first and second couplers may indicate a position of the first and second couplers, respectively. In one embodiment, the positioning data may include the distance D2 between couplers, the distance D1 between rail car bodies, the distance D3 between the rail body car and the coupler, a distance D4 between an edge or surface of the first rail body car 102*a* and the first coupler, a distance D5 between an edge or surface of the second rail body car 102*b* and the second coupler, a distance D6 between a surface of the track and the first coupler, and a distance D7 between a surface of the track and the second coupler. Optionally, the distance monitoring device may receive alternative distance data indicative of positions of the first and/or second rail cars, the first and/or second couplers, or the like.

With further reference to FIGS. 1 and 2, and in further non-limiting embodiments or aspects, the power source of the distance monitoring device 106 is configured to provide electronic power to the fastener 107, the distance sensor 108, the data connector 110, and/or the local processor, as required by the chosen implementation. The power source may include, but is not limited to, a battery pack (e.g., a nickel cadmium (NiCad) battery cell, a nickel metal hydride (NiMH) battery cell, a lithium ion (Li-ion) battery cell, etc.), a wired direct current or alternating current power connection, a wireless power transfer (WPT) receiver, and/or the like. More than one power source may be employed, and more than one type of power source may be used in combination. Batteries may be rechargeable, and the power source may be shared with one or more other electronic devices. For a train equipped with an electronically controlled pneumatic (ECP) braking system, which may include a power trainline (e.g., a car-to-car cable for transmitting electricity to power onboard electronics), the power source may be a wired power connection to the ECP power trainline. It will be appreciated that many configurations are possible.

With further reference to FIGS. 1 and 2, and in further non-limiting embodiments or aspects, the data connector 110 provides communication between the distance monitoring device 106 and a remote processor (i.e., a processor not of the distance monitoring device 106). The data connector 110 may be a wired or wireless connector to a wired or wireless data connection, or a combination thereof (e.g., a wired connection to a wireless transceiver). For a train equipped with an electronically controlled pneumatic (ECP) braking system, which may include a data trainline (e.g., a car-to-car cable for transmitting data signals from and/or to onboard electronics), the data connector 110 may be a wired data connection to the ECP data trainline. The data connector 110 may also be a wireless transceiver for wireless communication to a remote processor, such as a mobile device located with a train operator, an onboard computing device located on a locomotive associated the first rail car or the second rail car, a train dispatch or back office server, and/or the like. The data connector 110 may include, but is not limited to, a serial advanced technology attachment (SATA) connector, a serial attached SCSI (SAS) connector, a universal serial bus (USB) connector, an Ethernet connector, a Firewire connector, a radio transceiver, a Wi-Fi transceiver, an infrared communication transceiver, a satellite communication transceiver, and/or the like. The (wired and/or wireless) data connection of the data connector 110 to a remote processor may be persistent or non-persistent. It will be appreciated that many configurations are possible.

With further reference to FIGS. 1 and 2, and in further non-limiting embodiments or aspects, the local processor of the distance monitoring device 106 is configured to receive distance data from the distance sensor 108. The local processor may also be configured to communicate the distance data to a remote processor (e.g., a mobile device located with a train operator, an onboard computing device located on a locomotive associated the first rail car or the second rail car, a train dispatch or back office server, a computing device of a track bystander, and/or the like). The local processor may further be configured to cause the initiation of at least one train action at least partially based on the distance data. Train actions may include, but are not limited to, increasing movement of a rail car 102*a*, 102*b*, decreasing movement of a rail car 102*a*, 102*b*, stopping a rail car 102*a*, 102*b*, reversing movement of a rail car 102*a*, 102*b*, engaging/closing a coupler 104*a*, 104*b*, disengaging/opening a coupler 104*a*, 104*b*, and/or the like. The local processor may also be configured to increase a rate of receiving the distance data (e.g., through increased sample rate by the distance sensor 108 itself, through increased sample rate of the distance sensor 108 data stream, etc.) of the distance between the first rail car 102*a* and the second rail car 102*b* as the distance between the first rail car 102*a* and the second rail car 102*b* decreases. The local processor may also be configured to increase a rate of communicating the distance data to a remote processor as the distance between the first rail car 102*a* and the second rail car 102*b* decreases. In this manner, as the rail cars 102*a*, 102*b* move closer together, the increased rate of receiving data/communicating data allows for a more precise detection of the coupling process, and it reserves the highest energy/bandwidth of operation for when the coupling distance is closest to completion. It will be appreciated that many configurations are possible.

With further reference to FIGS. 1 and 2, and in further non-limiting embodiments or aspects, the distance data of the distance monitoring device 106 may be compared by a processor(e.g., a local processor of the distance monitoring device 106, a remote processor, etc.) to one or more threshold distances corresponding to train actions and/or coupling states (e.g., connected, not connected, close to a connection, etc.). In a non-limiting example, one threshold distance may correspond to a known distance required for the couplers 104*a*, 104*b* to engage between a first rail car 102*a* and a second rail car 102*b* of known types/configurations, and the monitored distance data may be compared to said threshold distance to trigger a halt of the rail cars 102*a*, 102*b* when the threshold is satisfied. It may be predetermined, for example, that the distance for engaging the couplers between a certain type of passenger car is three feet, as measured along a distance between rail car bodies D1. When the distance data indicates the distance between the rail car bodies D1 equals and/or is less than three feet, the movement of the rail cars 102*a*, 102*b* relative to one another may be halted. In another non-limiting example, a threshold distance may correspond to a distance between couplers D2 that indicates the couplers 104*a*, 104*b* are close to a completed connection, but are not yet engaged (e.g., a two meter gap between couplers). When the distance data indicates the distance between the couplers D2 equals and/or is less than two meters, the relative speed of the rail cars 102*a*, 102*b* to one another may be reduced to ensure a safe coupling speed. Similar calculations and thresholds may be established for a distance between a rail car body and coupler D3, or distances between any two rail car elements 102*a*, 102*b*. Threshold distances may be used to trigger one or more train actions including, but not limited to, increasing movement of a rail car 102*a*, 102*b*, decreasing movement of a rail car 102*a*, 102*b*, stopping a rail car 102*a*, 102*b*, reversing movement of a rail car 102*a*, 102*b*, engaging/closing a coupler 104*a*, 104*b*, disengaging/opening a coupler 104*a*, 104*b*, and/or the like. More than one threshold distance maybe employed for a given coupling process. It will be appreciated that many configurations are possible.

With further reference to FIGS. 1 and 2, and in further non-limiting embodiments or aspects, the distance monitoring device 106 may further include a speaker, an indicator light, a display, or any combination thereof. For non-limiting configurations where the distance monitoring device 106 augments a personnel's oversight of a coupling process, data feedback elements, such as a speaker, an indicator light, a display, and/or the like, may communicate statuses/data to a personnel. For example, a speaker may be provided to emit a sound (e.g., a beep, a chirp, a recorded message, etc.) as the distance monitoring device 106 is collecting distance data, and such a sound may reflect the sample rate of the distance sensor 108 and/or the current distance between the rail cars 102*a*, 102*b*. The speaker may also be configured to emit a sound for status changes of the distance monitoring device 106, such as powering on, powering off, beginning a monitoring process, terminating a monitoring process, and/or the like. The distance monitoring device 106 may further include an indicator light to reflect a status of the distance monitoring device 106, including, but not limited to, a power level status, an on/off status, a distance sensor 108 sample rate, a proximity/distance status, and/or the like. The distance monitoring device 106 may further include a display to allow personnel to configure the distance monitoring device 106, view distance data (both historic and/or current), check a status of the distance monitoring device 106, and/or the like. It will be appreciated that many configurations are possible.

Figure 3:
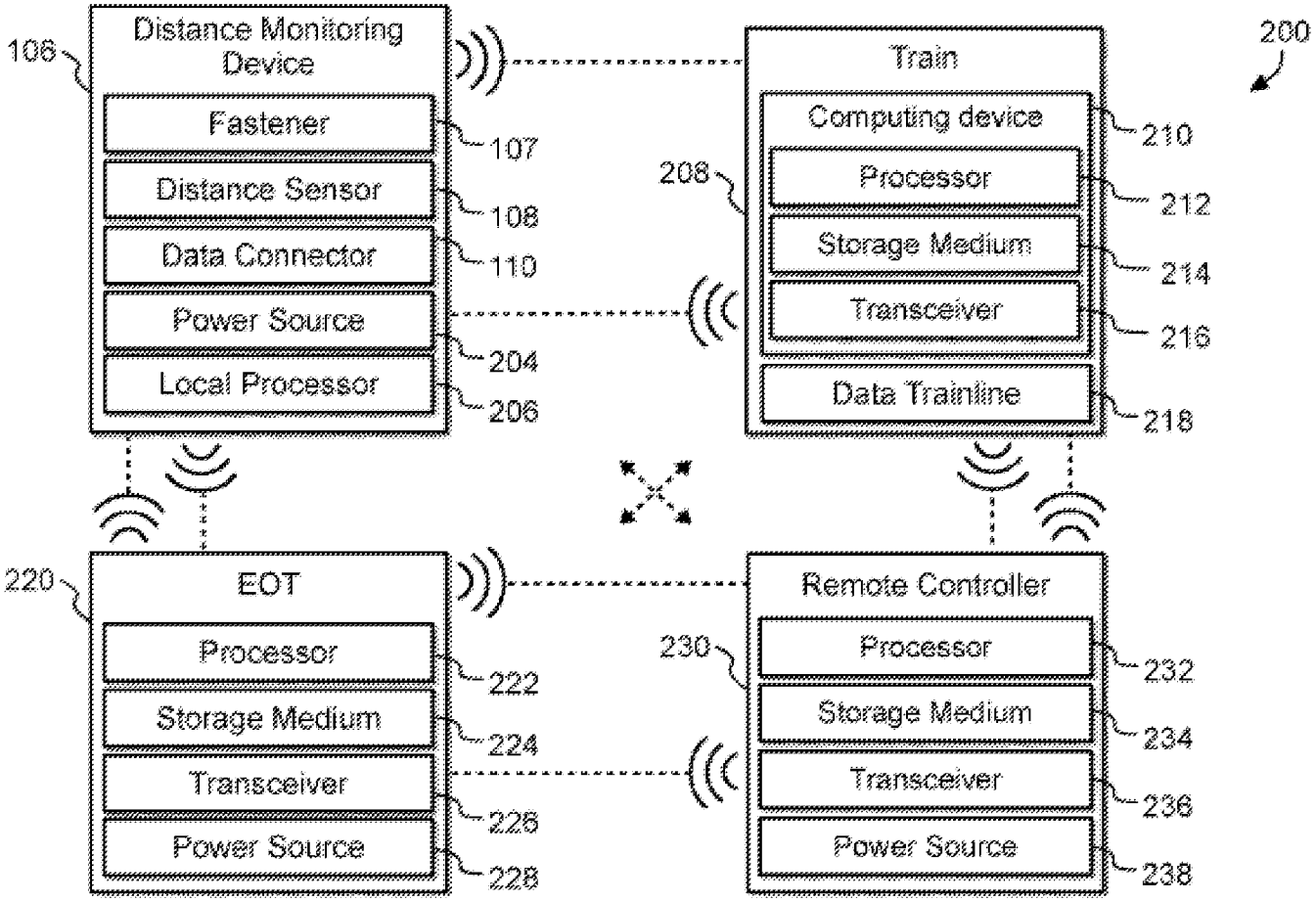
FIG. 3 is a schematic diagram of non-limiting embodiments or aspects of a device, system, and method for monitoring a distance between a first rail car and a second rail car during coupling.

With reference to FIG. 3, and in non-limiting embodiments or aspects, depicted is a network 200 for monitoring a distance between a first rail car and a second rail car during coupling. As illustrated, dashed lines indicate communicative connections, including wired communication channels, wireless communication channels, or a combination thereof. Provided is a train 208, upon which is located one or more distance monitoring devices 106 (abbreviated as "distance monitor" as shown), which are positioned on one or more rail cars of the train 208. Communication with the train 208 may be understood as communication with a computing device 210 or data trainline 218 thereof. The distance monitoring device 106 may include a fastener 107, a distance sensor 108, a data connector 110, a power source 204, and a local processor 206. The fastener 107 may include, but is not limited to, a magnet (e.g., a permanent magnet, an electromagnet, etc.), a magnetic material for attraction to a magnet on the rail car, a threaded fastener (e.g., nut-and-bolt, screw, stud, etc.), a clamp, a clip, a tie, a strap, a snap, and/or the like. One or more fasteners 107 may be used to secure the distance monitoring device 106 to a rail car, and more than one type of fastener may be used in combination. The fastener 107 may affix the distance monitoring device 106 to a rail car sidewall, a rail car frame (e.g., a flatcar bed), a coupler of a rail car, or any portion of a rail car such that the distance sensor 108 may determine the proximity of the rail cars during coupling. The distance sensor 108 may include, but is not limited to, a Doppler sensor, a magnetic field sensor, an optical sensor (e.g., photoelectric, photocell, laser rangefinder, infrared), a radar sensor, a LIDAR sensor, a sonar sensor, and/or the like. The distance monitoring device 106 may include one or more distance sensors 108 including one or more types of distance sensor 108. The distance monitoring device 106 may use the distance sensor 108 to determine a distance between rail car bodies, a distance between a rail car body and a coupler, a distance between couplers, or a combination thereof. It will be appreciated that many configurations are possible, and the distance monitoring device 106 may be configured to determine a distance between any point associated with the first rail car and any point associated with the second rail car.

With further reference to FIG. 3, and in further non-limiting embodiments or aspects, the data connector 110 may be a wired or wireless connector to a wired or wireless data connection, or a combination thereof (e.g., a wired connection to a wireless transceiver), and the data connector 110 may provide communication between the distance monitoring device 106 and a remote processor, e.g., an end-of-train (EQT) device 220, a train 208 computing device 210 (e.g., a locomotive ECP controller), and/or a remote controller 230 (e.g., a mobile device of a locomotive operator, a train dispatch of back office server, a computing device of a track bystander, and/or the like). For a train 208 equipped with an ECP braking system, which may include a data trainline 218 (e.g., a car-to-car cable for transmitting data signals from and/or to onboard electronics), the data connector 110 may be a wired data connection to the data trainline 218. The data connector 110 may also be a wireless transceiver for wireless communication to a remote controller 230, such as a mobile device located with a train operator, a train dispatch or back office server, a computing device of a track bystander, and/or the like. The data connector 110 may be a wired or wireless data transceiver to the EQT device 220, which may analyze the distance data and/or relay the distance data to a train 208 computing device 210. The data connector 110 may include, but is not limited to, a serial advanced technology attachment (SATA) connector, a serial attached SCSI (SAS) connector, a universal serial bus (USB) connector, an Ethernet connector, a Firewire connector, a radio transceiver, a Wi-Fi transceiver, an infrared communication transceiver, a satellite communication transceiver, and/or the like. The (wired and/or wireless) data connection of the data connector 110 to a train 208 computing device 210, an EQT device 220, or a remote controller 230 may be persistent or non-persistent. It will be appreciated that many configurations are possible.

With further reference to FIG. 3, and in further non-limiting embodiments or aspects, the power source 204 of the distance monitoring device 106 is configured to provide electronic power to the fastener 107, the distance sensor 108, the data connector 110, and/or the local processor 206, as required by the chosen implementation. The power source 204 may include, but is not limited to, a battery pack (e.g., a nickel cadmium (NiCad) battery cell, a nickel metal hydride (NiMH) battery cell, a lithium ion (Li-ion) battery cell, etc.), a wired direct current or alternating current power connection, a wireless power transfer (WPT) receiver, and/or the like. More than one power source 204 may be employed, and more than one type of power source 204 may be used in combination. Batteries may be rechargeable, and the power source 204 may be shared with one or more other electronic devices, such as an EQT device 220. For a train 208 equipped with an ECP braking system, which may include a power trainline (e.g., a car-to-car cable for transmitting electricity to power onboard electronics), the power source 204 may be a wired power connection to the ECP power trainline. It will be appreciated that many configurations are possible.

With further reference to FIG. 3, and in further non-limiting embodiments or aspects, the local processor 206 of the distance monitoring device 106 is configured to receive distance data from the distance sensor 108. Optionally, the local processor may receive the positioning data indicative of the position of the first coupler, and positioning data indicative of the position of the second coupler. The local processor 206 may also be configured to communicate the distance data and/or the positioning data to a remote processor, e.g., an EQT device 220, an onboard computing device 210 (e.g., located on a locomotive), a remote controller 230, such as a mobile device located with a train operator, a train dispatch or back office server, a computing device of a track bystander, and/or the like. The local processor 206 may further be configured to cause the initiation of at least one train action at least partially based on the distance data. Train actions may include, but are not limited to, increasing movement of a rail car, decreasing movement of a rail car, stopping a rail car, reversing movement of a rail car, engaging/closing a coupler, disengaging/opening a coupler, and/or the like. The local processor 206 may also be configured to increase a rate of receiving the distance data (e.g., through increased sample rate by the distance sensor 108 itself, through increased sample rate of the distance sensor 108 data stream, etc.) of the distance between the first rail car and the second rail car as the distance between the first rail car and the second railcar decreases. The local processor 206 may also be configured to increase a rate of communicating the distance data to a remote processor (e.g., an EQT device 220, a train 208 computing device 210, a remote controller 230, etc.) as the distance between the first rail car and the second rail car decreases. It will be appreciated that many configurations are possible.

With further reference to FIG. 3, and in further non-limiting embodiments or aspects, the train 208 may include a computing device 210 (e.g., a locomotive ECP controller), which may include a processor 212, a data storage medium 214 (e.g., non-transitory computer-readable media), and a transceiver 216 (for communication with other devices in the network 200). The computing device 210 may be positioned in or on the train 208, such as in the locomotive or on another rail car. The EQT device 220 may include a processor 222, a data storage medium 224 (e.g., non-transitory computer-readable media), a transceiver 226 (for communication with other devices in the network 200), and a power source 228. The power source 228 of the EQT device 220 is configured to provide electronic power to the processor 222, data storage medium 224, and transceiver 226. The power source 228 may include, but is not limited to, a battery pack (e.g., a nickel cadmium (NiCad) battery cell, a nickel metal hydride (NiMH) battery cell, a lithium ion (Li-ion) battery cell, etc.), a wired direct current or alternating current power connection, a wireless power transfer (WPT) receiver, and/or the like. More than one power source 228 may be employed, and more than one type of power source 228 may be used in combination. Batteries may be rechargeable, and the power source 228 may be shared with one or more other electronic devices, such as a distance monitoring device 106. For a train 208 equipped with an ECP braking system, which may include a power trainline (e.g., a car-to-car cable for transmitting electricity to power onboard electronics), the power source 228 may be a wired power connection to the ECP power trainline.

With further reference to FIG. 3, and in further non-limiting embodiments or aspects, the remote controller 230 may include a processor 232, a data storage medium 234 (e.g., non-transitory computer-readable media), a transceiver 236 (for communication with other devices in the network 200), and a power source 238 (e.g., a battery). The remote controller 230 may be any computing device configured to communicate with other devices in the network 200, including with the distance monitoring device 106, either directly or indirectly, such as a mobile device of a locomotive operator, a train dispatch or back office server, a computing device of a track bystander, and/or the like.

Figure 4:
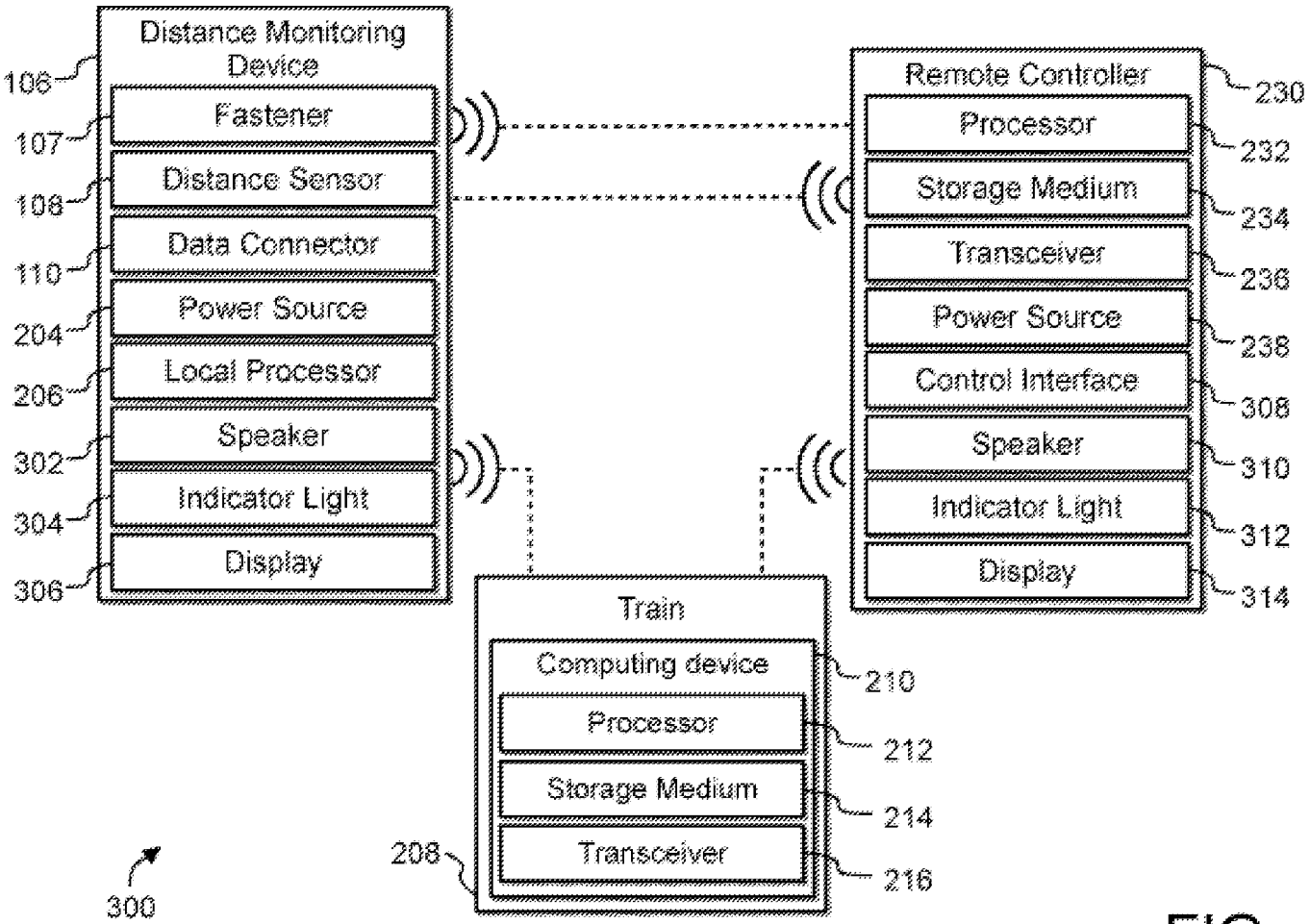
FIG. 4 is a schematic diagram of non-limiting embodiments or aspects of a device, system, and method for monitoring a distance between a first rail car and a second rail car during coupling.

With reference to FIG. 4, and in non-limiting embodiments or aspects, depicted is a network 300 for monitoring a distance between a first rail car and a second rail car during coupling. As illustrated, dashed lines indicate communicative connections, including wired communication channels, wireless communication channels, or a combination thereof. Provided is a train 208, upon which is located one or more distance monitoring devices 106 (abbreviated as "distance monitor" as shown), which are positioned on one or more rail cars of the train 208. Communication with the train 208 may be understood as communication with a computing device 210 or data trainline thereof. The distance monitoring device 106 may include a fastener 107, a distance sensor 108, a data connector 110, a power source 204, a local processor 206, a speaker 302, an indicator light 304, and a display 306. The distance monitoring device 106 may also be integrated with an EQT device. The fastener 107 may include, but is not limited to, a magnet (e.g., a permanent magnet, an electromagnet, etc.), a magnetic material for attraction to a magnet on the rail car, a threaded fastener (e.g., nut-and-bolt, screw, stud, etc.), a clamp, a clip, a tie, a strap, a snap, and/or the like. One or more fasteners 107 may be used to secure the distance monitoring device 106 to a rail car, and more than one type of fastener may be used in combination. The fastener 107 may affix the distance monitoring device 106 to a rail carside wall, a rail car frame (e.g., a flatcar bed), a coupler of a rail car, or any portion of a rail car such that the distance sensor 108 may determine the proximity of the rail cars during coupling. The distance sensor 108 may include, but is not limited to, a Doppler sensor, a magnetic field sensor, an optical sensor (e.g., photoelectric, photocell, laser rangefinder, infrared), a radar sensor, a LIDAR sensor, a sonar sensor, and/or the like. The distance monitoring device 106 may include one or more distance sensors 108, including one or more types of distance sensor 108. The distance monitoring device 106 may use the distance sensor 108 to determine a distance between rail car bodies, a distance between a rail car body and a coupler, a distance between couplers, or a combination thereof. It will be appreciated that many configurations are possible, and the distance monitoring device 106 may be configured to determine a distance between any point associated with the first rail car and any point associated with the second rail car.

With further reference to FIG. 4, and in further non-limiting embodiments or aspects, the data connector 110 may be a wired or wireless connector to a wired or wireless data connection, or a combination thereof (e.g., a wired connection to a wireless transceiver), and the data connector 110 may provide communication between the distance monitoring device 106 and a remote processor, e.g., a train 208 computing device 210 (e.g., a locomotive ECP controller), a remote controller 230 (e.g., a mobile device of a locomotive operator, a train dispatch of back office server, a computing device of a track bystander, etc.), and/or the like. The data connector 110 may be a wireless transceiver for wireless communication to a remote controller 230. The data connector 110 may include, but is not limited to, a serial advanced technology attachment (SATA) connector, a serial attached SCSI (SAS) connector, a universal serial bus (USB) connector, an Ethernet connector, a Firewire connector, a radio transceiver, a Wi-Fi transceiver, an infrared communication transceiver, a satellite communication transceiver, and/or the like. The (wired and/or wireless) data connection of the data connector 110 to a train 208 computing device 210, a remote controller 230, and/or the like may be persistent or non-persistent. It will be appreciated that many configurations are possible.

With further reference to FIG. 4, and in further non-limiting embodiments or aspects, the power source 204 of the distance monitoring device 106 is configured to provide electronic power to the fastener 107, the distance sensor 108, the data connector 110, and/or the local processor 206, as required by the chosen implementation. The power source 204 may include, but is not limited to, a battery pack (e.g., a nickel cadmium (NiCad) battery cell, a nickel metal hydride (NiMH) battery cell, a lithium ion (Li-ion) battery cell, etc.), a wired direct current or alternating current power connection, a wireless power transfer (WPT) receiver, and/or the like. More than one power source 204 may be employed, and more than one type of power source 204 may be used in combination. Batteries may be rechargeable, and a same power source 204 may be used for an integrated distance monitoring device 106 and EQT device. For a train 208 equipped with an ECP braking system, which may include a power trainline (e.g., a car-to-car cable for transmitting electricity to power onboard electronics), the power source 204 may be a wired power connection to the ECP power trainline. It will be appreciated that many configurations are possible.

With further reference to FIG. 4, and in further non-limiting embodiments or aspects, the local processor 206 of the distance monitoring device 106 is configured to receive distance data from the distance sensor 108. The local processor 206 may also be configured to communicate the distance data to a remote processor, e.g., an onboard computing device 210 (e.g., located on a locomotive), a remote controller 230, such as a mobile device located with a train operator, a train dispatch or back office server, a computing device of a track bystander, and/or the like. The local processor 206 may further be configured to cause the initiation of at least one train action at least partially based on the distance data. Train actions may include, but are not limited to, increasing movement of a rail car, decreasing movement of a rail car, stopping a rail car, reversing movement of a rail car, engaging/closing a coupler, disengaging/opening a coupler, and/or the like. The local processor 206 may also be configured to increase a rate of receiving the distance data (e.g., through increased sample rate by the distance sensor 108 itself, through increased sample rate of the distance sensor 108 data stream, etc.) of the distance between the first rail car and the second railcar as the distance between the first rail car and the second rail car decreases. The local processor 206 may also be configured to increase a rate of communicating the distance data to a remote processor (e.g., a train 208 computing device 210, a remote controller 230, etc.) as the distance between the first rail car and the second rail car decreases. It will be appreciated that many configurations are possible.

With further reference to FIG. 4, and in further non-limiting embodiments or aspects, the distance monitoring device 106 may include a speaker 302 to emit a sound (e.g., a beep, a chirp, a recorded message, etc.), such as when the distance monitoring device 106 is collecting distance data. Sounds produced by the speaker 302 may reflect a sample rate of the distance sensor 108 and/or the current distance between the rail cars 102*a*, 102*b* (e.g., a tempo/rhythm of sound proportional to the sample rate, inversely proportional to the distance, etc.). The speaker 302 may also be configured to emit a sound for status changes of the distance monitoring device 106, such as powering on, powering off, beginning a monitoring process, terminating a monitoring process, and/or the like. For implementations where the distance monitoring device 106 is integrated with an EQT device, the speaker 302 may perform the sound functions of both devices. It will be appreciated that many configurations are possible.

With further reference to FIG. 4, and in further non-limiting embodiments or aspects, the distance monitoring device 106 may further include an indicator light 304 to reflect a status of the distance monitoring device 106. Statuses may include, but not limited to, a power level status (e.g., green light for high battery level, yellow light for low battery level), an on/off status (e.g., illuminated when active), a distance sensor 108 sample rate (e.g., blinking at a tempo proportional to the sample rate), a proximity/distance status (e.g., green light when uncoupled and at a distance, red light when couplers have connected), and/or the like. The indicator light 304 may provide visual feedback to show that the distance monitoring device 106 is operating properly, and may further provide an additional layer of feedback should personnel be within sight-range of the distance monitoring device 106. It will be appreciated that many configurations are possible.

With further reference to FIG. 4, and in further non-limiting embodiments or aspects, the distance monitoring device 106 may further include a display to allow personnel to configure the distance monitoring device 106, view distance data (both historic and/or current), check a status of the distance monitoring device 106 (e.g., on/off, active/inactive, functional/errored), and/or the like. It will be appreciated that many configurations are possible.

With further reference to FIG. 4, and in further non-limiting embodiments or aspects, the train 208 may include a computing device 210 (e.g., a locomotive ECP controller), which may include a processor 212, a data storage medium 214 (e.g., non-transitory computer-readable media), and a transceiver 216 (for communication with other devices in the network 300). The computing device 210 may be positioned in or on the train 208, such as in the locomotive or on another rail car. The processor 212 may be used to analyze the distance data from the distance monitoring device 106 and automatically control operation of a locomotive of the train 208 to control the movement of the coupling. For example, the distance data may indicate a greater distance than a predetermined threshold for the rail cars being coupled, the threshold indicative of a distance required to engage the couplers of the rail cars. In response, the processor 212 may direct the locomotive to move one of the rail cars toward the other rail car, to reduce the distance between the rail cars. Thereafter, in response to determining that the distance data satisfies a threshold distance required for coupling, the processor 212 may direct the locomotive to halt movement (wherein, the coupling is presumed to be complete or able to be completed). The processor 212 may also reduce the speed of movement of a locomotive as the distance between the rail cars reduces, to allow for a safe speed for coupler connection. In this manner, a closed-loop automated coupling system can be established, allowing the train to self-couple cars through communications between the distance monitoring device 106 and a train 208 computing device 212. For couplers that must be engaged manually, the same steps may be carried out for a threshold indicative of a distance that the couplers are able to be manually connected. Moreover, for self-propelled rail cars that do not require a separate locomotive, the same steps may be carried out as an instruction to the self-propelled rail car to move along the track to complete a coupling operation. The computing device 210 may also present the distance data on a display to personnel (e.g., a locomotive operator), by which the personnel may control movement and train actions of the coupling operation. It will be appreciated that many configurations are possible.

With further reference to FIG. 4, and in further non-limiting embodiments or aspects, the remote controller 230 may include a processor 232, a data storage medium 234 (e.g., non-transitory computer-readable media), a transceiver 236 (for communication with other devices in the network 300), a power source 238 (e.g., a battery), a control interface 308 (e.g., a touch screen, a button array, etc.), a speaker 310, an indicator light 312, and a display 314. The remote controller 230 may be any computing device configured to communicate with other devices in the network 300, including with the distance monitoring device 106, either directly or indirectly, such as a mobile device of a locomotive operator, a train dispatch or back office server, a computing device of a track bystander, and/or the like. Both the train 208 computing device 210 and the remote controller 230 may be considered a remote processor for the purposes of receiving distance data, analyzing distance data, and/or controlling train actions related to the coupling process. It will be appreciated that many configurations are possible.

With further reference to FIG. 4, and in further non-limiting embodiments or aspects, the remote controller 230 may be used to analyze the distance data from the distance monitoring device 106 and automatically control operation of a locomotive of the train 208 (or self-propelled rail cars thereof) to control the movement of the coupling process. For example, the distance data may indicate a greater distance than a predetermined threshold for the rail cars being coupled, the threshold indicative of a distance required to engage the couplers of the rail cars. In response, the remote controller 230 may direct the locomotive (or self-propelled rail car engines/motors) to move one of the rail cars toward the other rail car, to reduce the distance between the rail cars. Thereafter, in response to determining that the distance data satisfies a threshold distance required for coupling, the remote controller 230 may direct the locomotive (or self-propelled rail car engines/motors or brakes) to halt movement (wherein, the coupling is presumed to be complete or able to be completed). The remote controller 230 may also reduce the speed of movement of a locomotive (or self-propelled rail car engines/motors) as the distance between the rail cars reduces, to allow for a safe speed for coupler connection. In this manner, a closed-loop automated coupling system can be established, allowing the train to self-couple cars through communications between the distance monitoring device 106 and a remote controller 230. For couplers that must be engaged manually, the same steps may be carried out for a threshold indicative of a distance that the couplers are able to be manually connected. The remote controller 230 may also present the distance data on a display 314 to personnel (e.g., a locomotive operator, a track bystander, a train dispatch or back office personnel, etc.), by which the personnel may control movement and train actions of the coupling operation through the control interface 308. In such arrangements, the speaker 310 may provide audio feedback to the personnel (e.g., tones or messages indicative of the distance or status of the coupling process), the indicator light 312 may provide visual feedback of a status of the remote controller (e.g., power level, on/off status, coupling process status, etc.), and the display 314 may provide visual feedback for monitoring and controlling the coupling process. It will be appreciated that many configurations are possible.

Figure 5:
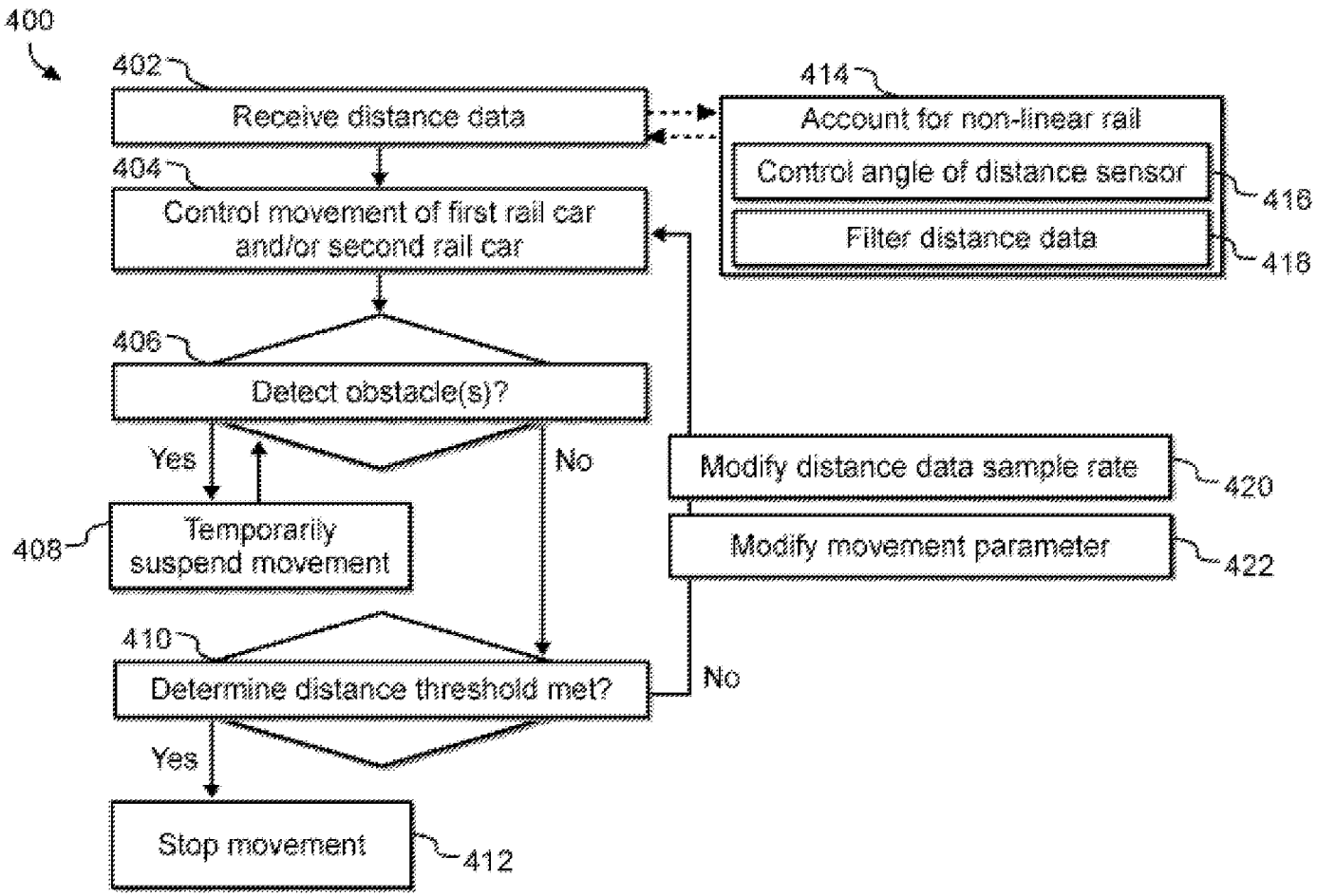
FIG. 5 is a process diagram of non-limiting embodiments or aspects of a device, system, and method for monitoring a distance between a first rail car and a second rail car during coupling.

With reference to FIG. 5, and in non-limiting embodiments or aspects, provided is a method 400 for monitoring a distance between a first rail car and a second rail car during coupling. The method 400 may be completed by a local processor of the distance monitoring device and/or a remote processor. The method 400 may include, at step 402, receiving distance data from a distance sensor of a distance monitoring device, the distance monitoring device affixed to one of, and positioned between, a first rail car and a second rail car. The distance sensor is configured to detect a distance between the first rail car and the second rail car in a direction away from an end of one rail car and toward an end of the other rail car. The detected distance may be a signal indicative of a value (e.g., 20 meters, 30 feet, etc.) or a category (e.g., near, far, connected). The method 400 may include, in step 404, automatically controlling movement of the first rail car and/or the second rail car to reduce the distance between the first rail car and the second rail car. Step 404 may be based at least partially on the distance data, e.g., if the distance data is above a threshold distance, continue reducing the distance between the rail cars, if the distance data satisfies a threshold indicative of nearly complete or complete, slow or halt movement, etc. The method 400 may include, in step 406, detecting one or more obstacles, if present, between the first rail car and the second rail car. Step 406 may be based at least partially on the distance data, e.g., the distance data may indicate a drop in distance that is unexpected and is indicative of a blockage, the distance data may indicate an uneven surface indicative of track damage or misalignment, the distance data may indicate a moving object that is not the other rail car, etc. Obstacles may include, but are not limited to, people, animals, or objects in the path (or potentially entering the path) of the coupling process, track damage, misalignment of the rail cars, misalignment of the couplers, and/or the like. If an obstacle is detected instep 406, the method 400 may include, in step 408, temporarily suspending movement of the first rail car and/or the second rail car until the at least one obstacle is no longer detected between the first rail car and the second rail car. It will be appreciated that many configurations are possible. In one or more embodiments, the distance monitoring device may communicate an alert responsive to detecting an obstacle on or entering the path of the rail cars, track damage, misalignment of the rail cars, misalignment of the couplers, or the like. For example, the distance monitoring device may communicate the alert to an operator onboard the first and/or second rail cars, to an operator off-board the rail cars, such as an operator located at a dispatch center, to other rail vehicles that may be moving along the same track (e.g., towards the first and second rail cars), or the like. In one or more embodiments, a priority of the alert may be based on the proximity of the first rail car to the second rail car, a speed of movement of one or both of the rail cars, a type of cargo being carried by the first and/or second rail cars, or the like. For example, the alert may have a lower priority based on the first and second rail cars being disposed a distance apart from each other that is greater than a threshold distance (e.g., 5 meters, 10 meters, or the like), or alternatively the alert may have a higher priority based on the first and second rail cars being disposed a distance apart from each other that is less than the threshold distance.

In one or more embodiments, the distance monitoring device may determine whether the first coupler is misaligned with the second coupler based on a comparison of the position of the first coupler with the position of the second coupler. For example, one or more of the local processor, the computing device and/or the remote controller may receiving the positioning data of the first coupler and the second coupler (e.g., distance data D1, D2, D3, D4, D5, D6, and/or D7) and compare the position of the first coupler with the position of the second coupler.

The local processor, the computing device and/or the remote controller may determine that the first coupler may be prohibited from coupling with the second coupler based on the first and second couplers are misaligned with each other. For example, the misaligned first and second couplers may be unable to successfully couple with each other while misaligned. In one embodiment, the first coupler may be determined to be misaligned with the second coupler based on a difference between the position of the first coupler and the position of the second coupler being outside a determined alignment threshold. The determined alignment threshold may be a distance threshold, a radial position threshold, a vertical threshold, or the like.

As one example, the distance D6 of the first coupler may be about 3 meters, and the distance D7 of the second coupler may be about 1 meter. The first and second couplers may be prohibited from coupling with each other based on the first and second couplers being positioned at different distances away from the surface of the track. As another example, the distance D4 of the first coupler may be about 2 meters, and the distance D5 of the second coupler may be about 5 meters. The first and second couplers being disposed at different distances away from surfaces of the corresponding rail vehicles may prohibit the first and second couplers from being coupled together. For example, the first coupler may collide or interfere with a portion of the second rail car, and/or the second coupler may collide or interfere with a portion of the first rail car based on the first and second couplers being misaligned with each other. As another example, the first coupler may be oriented at a first radial position (e.g., relative to one or more surfaces of the track or the first rail car), and the second coupler may be oriented at a second radial position (e.g., relative to one or more surfaces of the track or the second rail car). The different orientations of the first and second couplers may prohibit components of the first coupler from coupling with components of the second coupler.

In one or more embodiments, at step 404, the movement of the first and/or second rail cars may be based on the alignment of the first and second couplers. For example, the local processor, the computing device and/or the remote controller may determine that the first coupler is misaligned with the second coupler. The local processor of the distance monitoring device, the computing device of one or more of the rail cars, and/or the remote controller may initiate an action of one or more of the first coupler, the second coupler, the first rail car, and/or the second rail car based on the first coupler being misaligned with the second coupler. The action initiated by the local processors, the computing device, and/or remote controller may change the position of one or both of the first coupler or the second coupler, such that the first and second couplers may be aligned with each other within the determined alignment threshold. For example, the action may be to move the first coupler to change one or more of the distances D2, D3, D4, or D6; to move the second coupler to change one or more of the distances D2, D3, D5, or D7, or to move one of the first or second rail cars to change one or more of the distances D1 or D3. In one embodiment, the action may be to change a radial position of one or both of the first or second couplers. For example, the action may be to pivot or rotate one of the first or second couplers to change the radial position of the first or second coupler, respectively.

With further reference to FIG. 5, and in further non-limiting embodiments or aspects, the method 400 may include, in step 410, determining if a distance threshold is met (i.e., satisfied) that is representative of a completed rail car coupling. The distance threshold may be a value of a distance between the rail car bodies, the rail car couplers, or between two other points of the railcars that is known to be the distance when the rail cars are successfully coupled. For example, ten feet may be a known distance between the two rail car bodies when they are connected, and the distance threshold may be satisfied when the distance data indicates a distance between the two rail car bodies of ten feet or less. The distance threshold may further be categorical, wherein the underlying distance of a successful coupling is embedded in the distance data—e.g., when fifteen feet may be predetermined to be "near" coupling, and ten feet may be predetermined to be a "completed" coupling, distance data may indicate "near" at fifteen feet and "complete" at ten feet or less, thereby satisfying a distance threshold category of "complete." A threshold distance may be dynamically determined based on the rail cars involved in the coupling process, such as based on the type of rail car and the configuration of the rail car body, coupler, and/or the like. It will be appreciated that many configurations are possible. With further reference to FIG. 5, and in further non-limiting embodiments or aspects, the method 400 may include, in step 412, in response to determining that the distance threshold is satisfied, stopping movement of the first rail car and/or the second rail car. The method 400 may further include, in step 414, accounting for non-linear rail below the rail cars. For example, a rise, descent, or curve of the rail track may effectively change the threshold distance representative of a completed coupling and may interfere with detecting obstacles. Step 414 may be completed by controlling an angle of the distance sensor, in 416, such as to modify a sensing direction of the distance sensor to counteract the rise, descent, or curve of the rail track—i.e., raising the distance sensor angle on a rise, lowering the distance sensor angle on a descent, and/or angling the distance sensor left or right with left or right curves of the rail track. For example, the orientation of the distance sensor may be changed based on the rail cars being non-linear rail cars (e.g., the rail cars are positioned on a curved portion of a track). The position or orientation of the sensors may be remotely adjusted, such as by the remote controller, the computing device, or the like.

In one or more embodiments, changing the orientation of the distance sensor may change the positioning data of the first coupler and/or the positioning data of the second coupler detected by the distance sensor. Changes in angle of the distance sensor may be proportional to the changes in the non-linear rail. Changes in the non-linear rail may be detected by the distance sensor directly, another sensing device, or may be determined through track data stored in a data storage medium connected to a controlling processor and identified based on the geolocation of the distance monitoring device. Step 414 may further be completed by filtering or adjusting the distance data in step 418, instead of or in addition to step 416. As one example, the positioning data of the first coupler and/or the positioning data of the second coupler may be adjusted, such as by a determined algorithm or other calculation, based on the first and second rail cars being positioned on a non-linear route. As another example, the distance sensor may generate distance data with an effective "field of view," i.e., a sensed domain and range. The distance data may be filtered to focus on portions of the field of view, i.e., portions of the domain and range of sensed data, in the direction of the change in non-linear rail. For example, the upper field of view may be prioritized in filtering for a rise in rail track, the lower field of view may be prioritized in filtering for a descent in rail track, and/or an off-center field of view may be prioritized in filtering for a curve in rail track. It will be appreciated that many configurations are possible.

Figure 6:
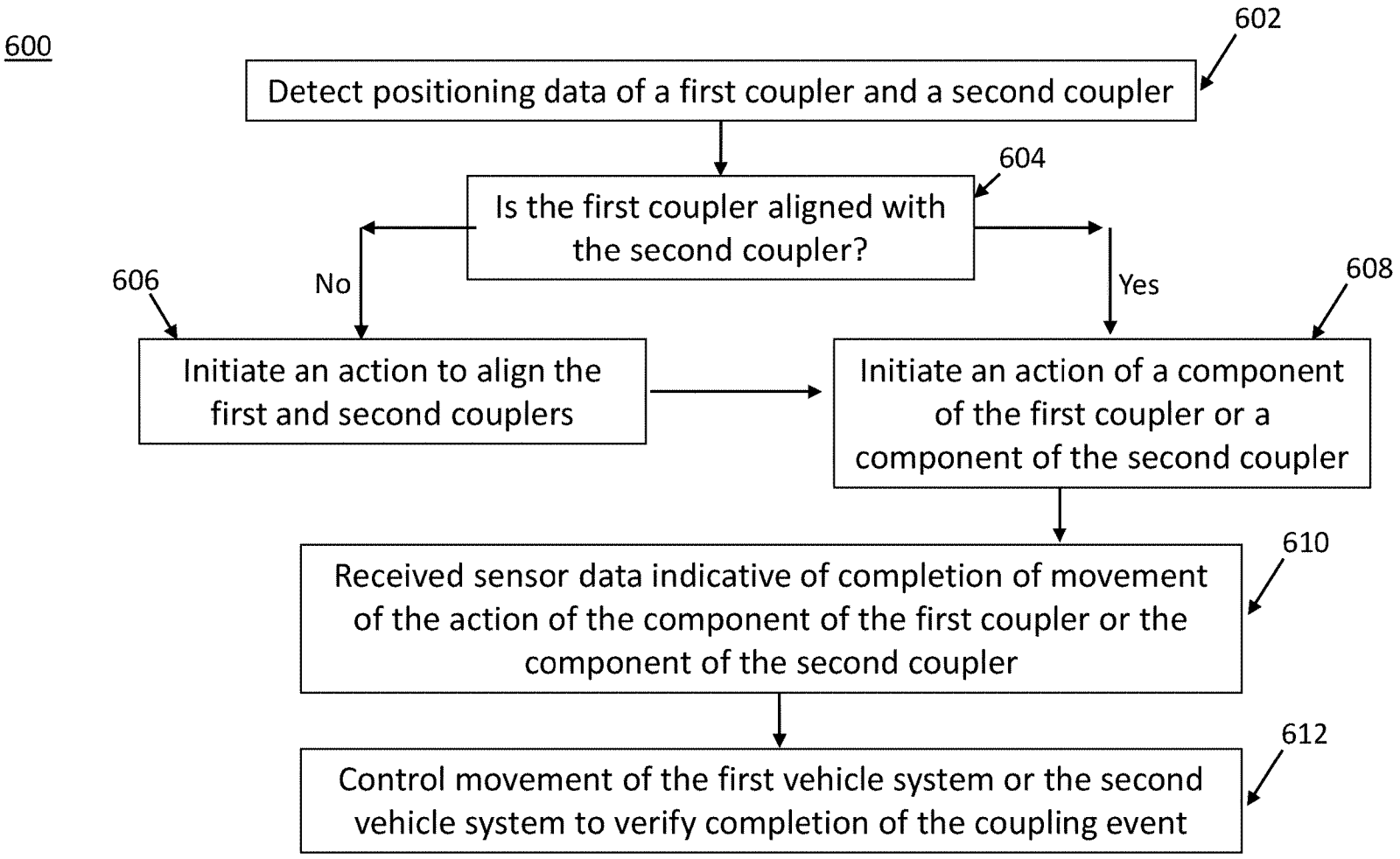
FIG. 6 illustrates one example of a flowchart of connecting couplers of vehicles in accordance with one embodiment.

In one or more embodiments, the distance monitoring device, the computer device, and/or the remote controller may control one or more actions of the first and/or second coupler during the coupling event. For example, FIG. 6 illustrates a flowchart 600 of one example of a method of connecting couplers of vehicle systems. The vehicle systems may be rail cars, or alternative vehicle systems such as automobiles, trucks, mining vehicles, agricultural vehicles, marine vessels, aircraft, or the like. At step 602, positioning data of a first coupler and a second coupler may be detected. The positioning data may be detected by one or more sensors, such as sensors of a distance monitoring device. Optionally, some of the positioning data may be detected by sensors separate from the distance monitoring device, such as wayside sensors, wayside devices, other vehicles, or the like. The positioning data may be communicated to one or more processors, such as processors of the distance monitoring device, a computing device of one or both of the vehicles being coupled together, a remote controller, or the like. The rate at which the positioning data is communicated by the sensors may be based on the distance between a first and second coupler, a distance between the two vehicles being coupled together during the coupling event, or the like. For example, as the distance between the couplers decreases, the rate at which the positioning data is communicated may increase, or as the distance between the couplers increases, the rate which the positioning data is communicated may decrease.

At step 604, a determination is made whether the first coupler and the second coupler are aligned with each other. The couplers may be determined to be misaligned with each other based on the positioning data of the first coupler compared with the positioning data of the second coupler. For example, the first and second couplers may be determined to be misaligned with each other based on a difference between the position of the first coupler and the position of the second coupler being outside of a determined alignment threshold. In one embodiment, the determined alignment threshold may be a predetermined value, percentage, ratio, or the like, that may be based on the type or style of couplers being used. For example, the first and second couplers may be buffer and chain couplers that may have a first determined alignment threshold, or alternatively the first and second couplers may be link and pin couplers that may have a second determined alignment threshold, that may be different than the first determined alignment threshold.

If it is determined that the first and second couplers are misaligned with each other outside of the determined alignment threshold, flow of the method proceeds toward step 606. Alternatively, if the first and second couplers are aligned with each other, such as within the determined alignment threshold, flow of the method proceeds toward step 608. At step 606, one or more actions of the first coupler, the second coupler, the first vehicle system, and/or the second vehicle system may be initiated. The one or more actions may be automatically initiated, such as by the local processor of the distance monitoring device, the computing device onboard one of the rail vehicles, the remote controller, or the like. The one or more actions may be to move or change a position of the first coupler, to move or change a position of the second coupler, or to move or change a position of one or both of the first or second vehicle systems. Optionally, the action may be to change a position of one or more components of the first coupler or one or more components of the second coupler. For example, the couplers may be hook couplers, and the positioning of the hook of the first coupler may be adjusted, pivoted, or the like, such that the first hook coupler is aligned with the second hook coupler. Optionally, the couplers may be link and pin couplers, and a position of the pin may be changed (e.g., moved up, down, toward one side or another, or the like) to align the pin with the link within the determined alignment threshold. Flow of the method may proceed toward step 608 responsive to the completion of the action to align the first and second couplers.

In one or more embodiments, the distance monitoring device may communicate an alert, such as to the computer device of one of the vehicle systems, the remote controller, or the like, indicating that the first coupler is misaligned with the second coupler. The alert may have or include a priority level that may be based on a distance between the first and second vehicles, distances between the first and second couplers (e.g., the distance away from the determined alignment threshold), a speed of movement of one or both of the vehicle systems, or the like.

At step 608, one or more actions of one or more components of the first coupler and/or one or more actions of one or more components of the second coupler may be automatically initiated to complete the coupling event. As one example, the first and second couplers may be link and pin couplers, and an action of the pin may be initiated to move the pin to be disposed at a position within the hook to complete the coupling event. As another example, the first and second couplers may be electromagnetic couplers, and a current may be applied to the first and/or second coupler to couple the first and second electromagnetic couplers with each other.

At step 610, the sensors of the distance monitoring device may detect sensor data indicative of the completion of movement of the one or more components of the first and/or second couplers. For example, the sensors may detect the positioning of the pin in the hook and pin couplers, and one or more processors may determine that the pin is in the correct position (e.g., fully loaded within the link) for completing the coupling event. Alternatively, the sensor data may indicate a position of the pin relative to the position of the link, and the one or more processors may determine that the pin is in an incorrect position, has not traveled far enough, or the like, to complete the coupling event. As another example, the processors may receive sensor data indicative of positioning of knuckle couplers, and may determine that the coupling event is completed or is not completed based on the positioning of each of the knuckle couplers relative to each other. In one or more embodiments, the processors may receive sensor data responsive to the coupling event being completed. In another embodiment, the processors may receive sensor data during the coupling event, such as to determine progress of the coupling event while the coupling event is occurring.

At step 612, the local processor of the distance monitoring device, the computer device of one of the vehicle systems, or a remote controller may automatically control movement of one or both of the vehicle systems. In one embodiment, the first vehicle system may be directed to move in a direction away from the second vehicle system subsequent to completing the coupling event. For example, the first vehicle system may be directed to move away from the second vehicle system to verify or confirm that the coupling event was successful, completed, and the first and second vehicles are coupled together. For example, the first and second vehicle systems may move away from each other such that the couplers are stretched apart from each other to confirm that the first and second vehicle systems are accurately coupled with each other.

Returning to FIG. 5, and in further non-limiting embodiments or aspects, the method 400 may include modifying a distance data sample rate of the distance sensor, in step 420. The sample rate may be increased in response to a detected decrease in the distance between the first rail car and the second rail car, to provide for added precision as the coupling nears completion. The increase in the sample rate may be a linear, progressing increase that is proportional to the decrease in distance between the rail cars. The sample rate may also be modified to increase or decrease the sample rate at different detected threshold distances between the rail cars. The method 400 may further include, in step 422, modifying a movement parameter of the first rail car or second rail car, as the coupling is in process. Movement parameters include, but are not limited to, speed of a rail car, speed of a locomotive associated with a rail car, a level of brake pipe pressure or brake engagement of a rail car, and/or the like. It will be appreciated that many configurations are possible.

With further reference to the foregoing figures, remote processors (e.g., train computing devices, remote controllers, etc.) may be manually operated and controlled by personnel to monitor and control rail car coupling processes. Such remote processors may include or be communicatively connected to a display to provide visual feedback of the coupling process. In arrangements where the distance monitoring device and/or distance sensor includes a camera configured to generate video/image data, the video/image data may be communicated to the display of the remote processor for viewing by personnel. The video/image data may allow the personnel to use a control interface of the remote processor (e.g., buttons, keyboard/mouse, levers, touchscreen, and/or the like) to control the movement of one or more rail cars and complete a coupling process. Remote processors may also assist with control of the train actions and may be partially or fully automated. It will be appreciated that many configurations are possible.

Although the disclosure has been described in detail for the purpose of illustration based on what is currently considered to be the most practical and preferred embodiments, it is to be understood that such detail is solely for that purpose and that the disclosure is not limited to the disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

In one embodiment, the distance monitoring device, the remote controller, and/or the computing device may have a local data collection system deployed that may use machine learning to enable derivation-based learning outcomes. The controller may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and behavior analytics, and the like.

In one embodiment, the distance monitoring device, the remote controller, and/or the computing device may include a policy engine that may apply one or more policies. These policies may be based at least in part on characteristics of a given item of equipment or environment. With respect to control policies, a neural network can receive input of a number of environmental and task-related parameters. These parameters may include an identification of a determined trip plan for a vehicle group, data from various sensors, and location and/or position data. The neural network can be trained to generate an output based on these inputs, with the output representing an action or sequence of actions that the vehicle group should take to accomplish the trip plan. During operation of one embodiment, a determination can occur by processing the inputs through the parameters of the neural network to generate a value at the output node designating that action as the desired action. This action may translate into a signal that causes the vehicle to operate. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes, which may be weighed relative to each other.

In one or more embodiments of the subject matter described herein, a system may include a sensor that may detect positioning data indicative of a position of a first coupler of a first vehicle system and positioning data indicative of a position of a second coupler of a second vehicle system during a coupling event of the first vehicle system and the second vehicle system. A controller may include one or more processors that may receive the positioning data of the first coupler and the positioning data of the second coupler. The controller may determine whether the first coupler is misaligned with the second coupler based on a comparison of the position of the first coupler and the position of the second coupler. The first coupler may be prohibited from coupling with the second coupler while the first and second couplers are misaligned. The controller may initiate at least one action of one or more of the first coupler, the second coupler, the first vehicle system, or the second vehicle system to change a position of one or more of the first coupler, the second coupler, the first vehicle system, or the second vehicle system. Changing the position of the one or more of the first coupler, the second coupler, the first vehicle system, or the second vehicle system aligns the first coupler with the second coupler.

Optionally, the first coupler may be determined to be misaligned with the second coupler based on a difference between the position of the first coupler and the position of the second coupler being outside a determined alignment threshold.

Optionally, initiating the at least one action of the one or more of the first coupler, the second coupler, the first vehicle system, or the second vehicle system aligns the first coupler with the second coupler within the determined alignment threshold.

Optionally, the determined alignment threshold may be one or more of a distance threshold, a radial position threshold, or a vertical threshold.

Optionally, the controller may communicate an alert responsive to determining that the first coupler is misaligned with the second coupler.

Optionally, the controller may initiate at least one action of one or more of a component of the first coupler or a component of the second coupler responsive to determining that the first coupler is aligned with the second coupler.

Optionally, the controller may receive sensor data from the sensor responsive to the initiation of the at least one action of the one or more of the component of the first coupler or the component of the second coupler. The sensor data may be indicative of completion of movement of the at least one action of the one or more of the component of the first coupler or the component of the second coupler and completion of the coupling event.

Optionally, the controller may control movement of one or more of the first vehicle system or the second vehicle system responsive to the initiation of the at least one action of the one or more of the component of the first coupler or the component of the second coupler. The controller may direct one of the first vehicle system or the second vehicle system to move in a direction away from the other of the first vehicle system or the second vehicle system to verify the completion of the coupling event.

Optionally, the controller may change an orientation of the sensor. Changing the orientation of the sensor may change the positioning data detected by the sensor.

Optionally, the controller may adjust one or more of the positioning data indicative of the position of the first coupler or the positioning data indicative of the position of the second coupler based on the first vehicle system and the second vehicle system being positioned on a non-linear route.

Optionally, the first vehicle system may be a first rail vehicle and the second vehicle system may be a second rail vehicle.

Optionally, the sensor may include one or more of a LIDAR sensor, a radar sensor, a sonar sensor, an optical sensor, an ultrasonic sensor, or a thermal sensor.

In one or more embodiments of the subject matter described herein, a method may include detecting positioning data indicative of a position of a first coupler of a first vehicle system and positioning data indicative of a position of a second coupler of a second vehicle system during a coupling event of the first vehicle system and the second vehicle system. A determination may be made whether the first coupler is misaligned with the second coupler based on a comparison of the position of the first coupler and the position of the second coupler. The first coupler may be prohibited from coupling with the second coupler while the first and second couplers are misaligned. At least one action of one or more of the first coupler, the second coupler, the first vehicle system, or the second vehicle system may be initiated responsive to determining that the first coupler is misaligned with the second coupler to change a position of one or more of the first coupler, the second coupler, the first vehicle system, or the second vehicle system. Changing the position of one or more of the first coupler, the second coupler, the first vehicle system, or the second vehicle system aligns the first coupler with the second coupler.

Optionally, at least one action of one or more of a component of the first coupler or a component of the second coupler may be initiated responsive to determining that the first coupler is aligned with the second coupler.

Optionally, sensor data may be received from a sensor responsive to the initiation of the at least one action of the one or more of the component of the first coupler or the component of the second coupler. The sensor data may be indicative of completion of the at least one of the one or more of the component of the first coupler or the component of the second coupler.

Optionally, movement of one or more of the first vehicle system or the second vehicle system may be controlled responsive to the initiation of the at least one action of the one or more of the component of the first coupler or the component of the second coupler to move in a direction away from the other of the first vehicle system or the second vehicle system.

Optionally, an orientation of the sensor may be changed to change one or more of the positioning data indicative of the position of the first coupler or the positioning data indicative of the position of the second coupler.

Optionally, it may be determined that the first coupler is misaligned with the second coupler based on a difference between the position of the first coupler and the position of the second coupler is outside a determined alignment threshold. The determined alignment threshold may be one or more of a distance threshold, a radial position threshold, or a vertical threshold.

Optionally, one or more of the positioning data indicative of the position of the first coupler or the positioning data indicative of the position of the second coupler may be adjusted based on the first vehicle system and the second vehicle system being positioned on a non-linear route.

In one or more embodiments of the subject matter described herein, a system may include a monitoring device including one or more sensors that may detect positioning data indicative of a position of a first coupler of a first rail vehicle and positioning data indicative of a position of a second coupler of a second rail vehicle during a coupling event of the first rail vehicle and the second rail vehicle. A controller may include one or more processors that may control operation of one or more of the first coupler, the second coupler, the first rail vehicle, or the second rail vehicle. The controller may receive the positioning data of the first coupler and the positioning data of the second coupler. The controller may determine whether the first coupler is misaligned with the second coupler based on a comparison of the position of the first coupler and the position of the second coupler. The first coupler may be determined to be misaligned with the second coupler based on a difference between the position of the first coupler and the position of the second coupler being outside a determined alignment threshold. The controller may initiate at least one action of one or more of the first coupler, the second coupler, the first rail vehicle, or the second rail vehicle responsive to determining that the first coupler is misaligned with the second coupler to change a position of one or more of the first coupler, the second coupler, the first rail vehicle, or the second rail vehicle. Changing the position of the one or more of the first coupler, the second coupler, the first rail vehicle, or the second rail vehicle aligns the first coupler with the second coupler. The controller may initiate at least one action of one or more of a component of the first coupler or a component of the second coupler responsive to determining that the first coupler is aligned with the second coupler. The controller may receive sensor data from the monitoring device responsive to the initiation of the at least one action of the one or more of the component of the first coupler or the component of the second coupler. The sensor data may be indicative of completion of the at least one action of the one or more of the component of the first coupler or the component of the second coupler and completion of the coupling event.

As used herein, an element or step recited in the singular and proceeded with the word "a" or "an" do not exclude the plural of said elements or operations, unless such exclusion is explicitly stated. Furthermore, references to "one embodiment" of the invention do not exclude the existence of additional embodiments that incorporate the recited features. Moreover, unless explicitly stated to the contrary, embodiments "comprising," "comprises," "including," "includes," "having," or "has" an element or a plurality of elements having a particular property may include additional such elements not having that property. In the appended claims, the terms "including" and "in which" are used as the plain-English equivalents of the respective terms "comprising" and "wherein." Moreover, in the following claims, the terms "first," "second," and "third," etc. are used merely as labels, and do not impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function devoid of further structure.

For purposes of the description hereinafter, the terms "end," "upper," "lower," "right," "left," "vertical," "horizontal," "top," "bottom," "lateral," "longitudinal," and derivatives thereof shall relate to the example(s) as oriented in the drawing figures. However, it is to be understood that the example(s) may assume various alternative variations and step sequences, except where expressly specified to the contrary. It is also to be understood that the specific example(s) illustrated in the attached drawings, and described in the following specification, are simply exemplary examples or aspects of the disclosure. Hence, the specific examples or aspects disclosed herein are not to be construed as limiting. Also, it should be understood that any numerical range recited herein is intended to include all sub-ranges subsumed therein. For example, a range of 1 to 10 is intended to include all sub-ranges between (and including) the recited minimum value of 1 and the recited maximum value of 10, that is, having a minimum value equal to or greater than 1 and a maximum value of equal to or less than 10.

As used herein, the terms "communication" and "communicate" refer to the receipt or transfer of one or more signals, messages, commands, or other type of data. For one unit (e.g., any device, system, or component thereof) to be in communication with another unit means that the one unit is able to directly or indirectly receive data from and/or transmit data to the other unit. This may refer to a direct or indirect connection that is wired and/or wireless in nature. Additionally, two units may be in communication with each other even though the data transmitted may be modified, processed, relayed, and/or routed between the first and second unit. For example, a first unit may be in communication with a second unit even though the first unit passively receives data and does not actively transmit data to the second unit. As another example, a first unit may be in communication with a second unit if an intermediary unit processes data from one unit and transmits processed data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, Global System for Mobile Communications (GSM), and/or the like.

As used herein, the term "mobile device" may refer to one or more portable electronic devices configured to communicate with one or more networks. As an example, a mobile device may include a cellular phone (e.g., a smartphone or standard cellular phone), a portable computer (e.g., a tablet computer, a laptop computer, etc.), a wearable device (e.g., a watch, pair of glasses, lens, clothing, and/or the like), a personal digital assistant (PDA), and/or other like devices.

As used herein, the term "server" may refer to or include one or more processors or computers, storage devices, or similar computer arrangements that are operated by or facilitate communication and processing for multiple parties in a network environment, such as the internet. In some non-limiting embodiments, communication may be facilitated over one or more public or private network environments and that various other arrangements are possible. Further, multiple computers, e.g., servers, or other computerized devices, e.g., mobile devices, directly or indirectly communicating in the network environment may constitute a system, such as a remote train and drone control system. Reference to a server or a processor, as used herein, may refer to a previously-recited server and/or processor that is recited as performing a previous step or function, a different server and/or processor, and/or a combination of servers and/or processors. For example, as used in the specification and the claims, a first server and/or a first processor that is recited as performing a first step or function may refer to the same or different server and/or a processor recited as performing a second step or function.

The above description is illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein define the parameters of the inventive subject matter, they are exemplary embodiments. Other embodiments will be apparent to one of ordinary skill in the art upon reviewing the above description. The scope of the inventive subject matter should, therefore, be determined with reference to the appended claims, along with the full scope of equivalents to which such claims are entitled.

This written description uses examples to disclose several embodiments of the inventive subject matter, including the best mode, and to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a sensor configured to detect positioning data indicative of a position of a first coupler of a first vehicle system and positioning data indicative of a position of a second coupler of a second vehicle system during a coupling event of the first vehicle system and the second vehicle system; and a controller comprising one or more processors configured to receive the positioning data of the first coupler and the positioning data of the second coupler, the controller configured to determine whether the first coupler is misaligned with the second coupler based on a comparison of the position of the first coupler and the position of the second coupler, wherein the first coupler is prohibited from coupling with the second coupler while the first and second couplers are misaligned, the controller configured to initiate at least one action of one or more of the first coupler, the second coupler, the first vehicle system, or the second vehicle system responsive to determining that the first coupler is misaligned with the second coupler to change a position of one or more of the first coupler, the second coupler, the first vehicle system, or the second vehicle system, wherein changing the position of the one or more of the first coupler, the second coupler, the first vehicle system, or the second vehicle system aligns the first coupler with the second coupler, wherein the first coupler is determined to be misaligned with the second coupler based on a difference between the position of the first coupler and the position of the second coupler being outside a determined alignment threshold, wherein the determined alignment threshold comprises a radial position threshold.

2. The system of claim 1, wherein initiating the at least one action of the one or more of the first coupler, the second coupler, the first vehicle system, or the second vehicle system aligns the first coupler with the second coupler within the determined alignment threshold.

3. The system of claim 1, wherein the determined alignment threshold further comprises a distance threshold or a vertical threshold.

4. The system of claim 1, wherein the controller is configured to communicate an alert responsive to determining that the first coupler is misaligned with the second coupler.

5. The system of claim 1, wherein the controller is configured to initiate at least one action of one or more a component of the first coupler or a component of the second coupler responsive to determining that the first coupler is aligned with the second coupler.

6. The system of claim 5, wherein the controller is configured to receive sensor data from the sensor responsive to the initiation of the at least one action of the one or more of the component of the first coupler or the component of the second coupler, the sensor data indicative of completion of the at least one action of the one or more of the component of the first coupler or the component of the second coupler.

7. The system of claim 5, wherein the controller is configured to control movement of one or more of the first vehicle system of the second vehicle system responsive to the initiation of the at least one action of the one or more of the component of the first coupler or the component of the second coupler, the controller configured to direct one of the first vehicle system or the second vehicle system to move in a direction away from the other of the first vehicle system or the second vehicle system.

8. The system of claim 1, wherein the controller is configured to change an orientation of the sensor, wherein changing the orientation of the sensor changes one or more of the positioning data indicative of the position of the first coupler or the positioning data indicative of the position of the second coupler.

9. The system of claim 1, wherein the controller is configured to adjust one or more of the positioning data indicative of the position of the first coupler or the positioning data indicative of the position of the second coupler based on the first vehicle system and the second vehicle system being positioned on a non-linear route.

10. The system of claim 1, wherein the first vehicle system is a first rail vehicle and the second vehicle system is a second rail vehicle.

11. The system of claim 1, wherein the sensor includes one or more of a LIDAR sensor, a radar sensor, a sonar sensor, an optical sensor, an ultrasonic sensor, or a thermal sensor.

12. A method comprising:

detecting positioning data indicative of a position of a first coupler of a first vehicle system and positioning data indicative of a position of a second coupler of a second vehicle system during a coupling event of the first vehicle system and the second vehicle system;

determining whether the first coupler is misaligned with the second coupler based on a comparison of the position of the first coupler and the position of the second coupler, wherein the first coupler is prohibited from coupling with the second coupler while the first and second couplers are misaligned;

initiating at least one action of one or more of the first coupler, the second coupler, the first vehicle system, or the second vehicle system responsive to determining that the first coupler is misaligned with the second coupler to change a position of one or more of the first coupler, the second coupler, the first vehicle system, or the second vehicle system, wherein changing the position of the one or more of the first coupler, the second coupler, the first vehicle system, or the second vehicle system aligns the first coupler with the second coupler; and determining that the first coupler is misaligned with the second coupler based on a difference between the position of the first coupler and the position of the second coupler being outside a determined alignment threshold, wherein the determined alignment threshold comprises a radial position threshold.

13. The method of claim 12, further comprising initiating at least one action of one or more of a component of the first coupler or a component of the second coupler responsive to determining that the first coupler is aligned with the second coupler.

14. The method of claim 13, further comprising receiving sensor data from a sensor responsive to the initiation of the at least one action of the one or more of the component of the first coupler or the component of the second coupler, the sensor data indicative of completion of the at least one action of the one or more of the component of the first coupler or the component of the second coupler.

15. The method of claim 13, further comprising controlling movement of one or more of the first vehicle system or the second vehicle system responsive to the initiation of the at least one action of the one or more of the component of the first coupler or the component of the second couple to move one of the first vehicle system or the second vehicle system in a direction away from the other of the first vehicle system or the second vehicle system.

16. The method of claim 12, further comprising changing an orientation of the sensor to change one or more of the positioning data indicative of the position of the first coupler or the positioning data indicative of the position of the second coupler.

17. The method of claim 12, wherein the determined alignment threshold comprises a distance threshold or a vertical threshold.

18. The method of claim 12, further comprising adjusting one or more of the positioning data indicative of the position of a first coupler or the positioning data indicative of the position of a second coupler based on the first vehicle system and the second vehicle system being positioned on a non-linear route.

19. A system comprising:

a monitoring device comprising one or more sensors configured to detect positioning data indicative of a position of a first coupler of a first rail vehicle and positioning data indicative of a position of a second coupler of a second rail vehicle during a coupling event of the first rail vehicle and the second rail vehicle; and a controller comprising one or more processors configured to control operation of one or more of the first coupler, the second coupler, the first rail vehicle, or the second rail vehicle, the controller configured to receive the positioning data of the first coupler and the positioning data of the second coupler, the controller configured to determine whether the first coupler is misaligned with the second coupler based on a comparison of the position of the first coupler and the position of the second coupler, wherein the first coupler is determined to be misaligned with the second coupler based on a difference between the position of the first coupler and the position of the second coupler being outside a determined alignment threshold, the controller configured to initiate at least one action of one or more of the first coupler, the second coupler, the first rail vehicle, or the second rail vehicle responsive to determining that the first coupler is misaligned with the second coupler to change a position of one or more of the first coupler, the second coupler, the first rail vehicle, or the second rail vehicle, wherein changing the position of the one or more of the first coupler, the second coupler, the first rail vehicle, or the second rail vehicle aligns the first coupler with the second coupler, and the controller configured to initiate at least one action of one or more a component of the first coupler or a component of the second coupler responsive to determining that the first coupler is aligned with the second coupler, wherein the controller is configured to receive sensor data from the monitoring device responsive to the initiation of the at least one action of the one or more of the component of the first coupler or the component of the second coupler, the sensor data indicative of completion of movement of the at least one action of the one or more of the component of the first coupler or the component of the second coupler and completion of the coupling event, wherein the first coupler is determined to be misaligned with the second coupler based on a difference between the position of the first coupler and the position of the second coupler being outside a determined alignment threshold, wherein the determined alignment threshold comprises a radial position threshold.

* * * * *